US010329040B2

(12) United States Patent
Mitani et al.

(10) Patent No.: US 10,329,040 B2
(45) Date of Patent: Jun. 25, 2019

(54) MEDICINE DISPENSING CASSETTE

(71) Applicant: YUYAMA MFG. CO., LTD., Toyonaka-shi, Osaka (JP)

(72) Inventors: Mitsuhiro Mitani, Toyonaka (JP); Takanori Yorozu, Toyonaka (JP)

(73) Assignee: YUYAMA MFG. CO., LTD., Osaka (JP)

( * ) Notice: Subject to any disclaimer, the term of this patent is extended or adjusted under 35 U.S.C. 154(b) by 127 days.

(21) Appl. No.: 15/565,892

(22) PCT Filed: Apr. 4, 2016

(86) PCT No.: PCT/JP2016/060994
§ 371 (c)(1),
(2) Date: Oct. 11, 2017

(87) PCT Pub. No.: WO2016/167148
PCT Pub. Date: Oct. 20, 2016

(65) Prior Publication Data

US 2018/0105300 A1 Apr. 19, 2018

(30) Foreign Application Priority Data

Apr. 11, 2015 (JP) ..... 2015-081308

(51) Int. Cl.
*B65B 35/26* (2006.01)
*B65D 35/26* (2006.01)
(Continued)

(52) U.S. Cl.
CPC ..... *B65B 35/26* (2013.01); *A61J 1/00* (2013.01); *A61J 3/00* (2013.01); *A61J 7/0084* (2013.01); *B65D 35/26* (2013.01); *B65D 43/20* (2013.01)

(58) Field of Classification Search
CPC ..... A61J 7/0076; A61J 7/0409; A61J 7/0084; A61J 3/00; B65B 57/14; B65B 1/10;
(Continued)

(56) References Cited

U.S. PATENT DOCUMENTS 4,496,177 A * 1/1985 Pissot ..... E05C 19/06 292/288
6,170,229 B1 * 1/2001 Kim ..... B65B 35/56 221/265
(Continued)

FOREIGN PATENT DOCUMENTS

JP 2000-010396 A 1/2000
JP 2014-518141 A 7/2014
(Continued)

OTHER PUBLICATIONS

ISA/JPO, International Search Report issued in PCT/JP2016/060994, dated May 24, 2016, total 8 pages with English translation.

*Primary Examiner* — Jacob S. Scott
*Assistant Examiner* — Ayodeji T Ojofeitimi
(74) *Attorney, Agent, or Firm* — Masuvalley & Partners

(57) ABSTRACT

An object of the present invention is to allow a medicine dispensing cassette to be easily disassembled. The medicine dispensing cassette according to the embodiments of the present invention may include a main member, a first sub-member, a second sub-member and a third sub-member. The main member further includes an engagement release member so that when said engagement release member is moved to a first position (F), the engagement between the main member and the first sub-member is released, making it possible to separate the first sub-member from the main member. In the same manner, when the engagement release member is moved to a second position (S), the engagement between the main member and the second sub-member is released, making it possible to separate the second sub-
(Continued)

member from the main member. The third sub-member can be removed from the main member independently from an operation of the engagement release member.

20 Claims, 19 Drawing Sheets

(51) Int. Cl.
*B65D 43/20* (2006.01)
*A61J 3/00* (2006.01)
*A61J 1/00* (2006.01)
*A61J 7/00* (2006.01)

(58) Field of Classification Search
CPC ..... B65B 35/26; B65B 43/305; B65B 5/103; B65D 43/20; G07F 17/0092; A47J 37/1228
USPC .... 221/19, 152, 151, 154, 295, 263; 53/155, 53/238; 206/540; 426/392, 438
See application file for complete search history.

(56) References Cited

U.S. PATENT DOCUMENTS 6,256,963 B1 * 7/2001 Kim ..... B65B 5/103 221/265
6,349,848 B1 * 2/2002 Uema ..... G07F 17/0092 221/6
6,471,090 B1 * 10/2002 Inamura ..... G07F 11/44 221/124
6,644,504 B2 * 11/2003 Yuyama ..... B65B 5/103 221/130
8,863,984 B2 * 10/2014 Siebel ..... A47K 10/422 221/62
10,010,485 B2 * 7/2018 Takahama ..... A61J 3/00
10,045,914 B2 * 8/2018 Yuyama ..... G06F 19/3462
2004/0099683 A1 5/2004 Shows et al.
2010/0078445 A1 * 4/2010 Nam ..... B65B 35/08 221/154
2010/0114367 A1 * 5/2010 Barrett ..... G06F 19/3456 700/236
2010/0287880 A1 * 11/2010 Yasunaga ..... A61J 7/0084 53/64
2011/0101018 A1 * 5/2011 Shafir ..... A47F 1/00 221/1
2011/0170655 A1 * 7/2011 Yuyama ..... G07F 11/66 377/6
2011/0215012 A1 * 9/2011 Haggard ..... G11B 33/025 206/308.1
2011/0309101 A1 * 12/2011 Kokie ..... A61J 7/0007 221/30
2013/0240555 A1 * 9/2013 Kim ..... B65B 5/103 221/1
2013/0284755 A1 * 10/2013 Yuyama ..... A61J 7/02 221/13
2014/0014678 A1 * 1/2014 Yuyama ..... G07F 11/44 221/277
2014/0097197 A1 * 4/2014 Nguyen ..... A61J 1/03 221/154
2014/0144925 A1 * 5/2014 Weber ..... F03G 7/065 221/154
2015/0014343 A1 * 1/2015 Koike ..... G07F 17/0092 221/9
2015/0217929 A1 * 8/2015 Morita ..... B65B 35/08 221/265
2016/0151245 A1 * 6/2016 Yuyama ..... G07F 11/24 221/277
2016/0220448 A1 * 8/2016 Takahama ..... A61J 7/0076
2016/0229564 A1 * 8/2016 Koike ..... A61J 7/0076
2017/0224587 A1 * 8/2017 Koike ..... A61J 7/0084

FOREIGN PATENT DOCUMENTS

JP 2015-058569 A 3/2015
WO 2010/110360 A1 9/2010
WO 2015/041220 A1 3/2015

* cited by examiner

MEDICINE DISPENSING CASSETTE

RELATED APPLICATIONS

This application is a national phase application under 35 U.S.C. § 371 of International Patent Application No. PCT/JP2016/060994, filed on Apr. 4, 2016, which claims priority under 35 U.S.C. § 119 to Japanese Patent Application No. 2015-081308, filed on Apr. 11, 2015, which are hereby expressly incorporated by reference in their entirety for all purposes.

TECHNICAL FIELD

The present invention relates to a medicine dispensing cassette for dispensing medicines contained therein.

BACKGROUND ART

A medicine dispensing apparatus for automatically dispensing prescribed medicines by a prescribed number based on a prescription is well known in the art. For example, the applicant of the present application developed a medicine dispensing apparatus as described in patent document 1: WO 2010/110360. This medicine dispensing apparatus gets a good reputation and receives a high evaluation from prescription professionals that the medicine dispensing apparatus makes a prescription work more efficient.

In this medicine dispensing apparatus, various kinds of medicines to be dispensed are stored in a plurality of cassettes. When the medicines are dispensed and any one of the cassettes becomes empty, a prescription professional needs to take the cassette from the apparatus to restock the medicines into the cassette with his/her own hands. At this time, a mistake that the prescription professional restocks improper medicines into the cassette may occur.

Further, among various kinds of medicines, there is a kind of medicine whose powder peels off and falls from its surface. In a case that such a kind of medicine is contained in the cassette and the cassette in which the medicine is contained is used for a long term, the powder is deposited in the cassette and a part of the deposited powder gets into narrow spaces. Thus, there is a request from some users of improving the cassette so that the cassette can be disassembled and washed.

SUMMARY OF THE INVENTION

One of objects of the present invention is to prevent improper medicines from being restocked into a medicine dispensing cassette. Another object of the present invention is to allow the medicine dispensing cassette to be easily disassembled.

a medicine dispensing cassette according to a first aspect has a main member, a first sub-member, a second sub-member, a third sub-member, a first rotating body, a second rotating body and a cylindrical member. Further, the main member includes an engagement release member. When this engagement release member is moved to a first position, an engagement between the main member and the first sub-member is released, and thereby the first sub-member becomes possible to be separated from the main member. In addition, when the first sub-member is separated from the main member, the first rotating body becomes possible to be separated from the main member. Next, when the engagement release member is moved to a second position, an engagement between the main member and the second sub-member is released, and thereby the second sub-member becomes possible to be separated from the main member. In addition, when the second sub-member is separated from the main member, the cylindrical member becomes possible to be separated from the main member. Further, the third sub-member can be removed from the main member independently from an operation of the engagement release member. The second rotating body is attached to the third sub-member. When the third sub-member is removed from the main member, the second rotating body becomes possible to be removed from the third sub-member.

An engagement release member according to a first aspect has an engagement release member first engaging portion and an engagement release member second engaging portion. Further, the first sub-member has a first sub-member first engaging portion and a first sub-member second engaging portion. When the first sub-member is engaged with the main member, the engagement release member first engaging portion is engaged with the first sub-member first engaging portion. When the engagement release member is moved to the first position, an engagement between the engagement release member first engaging portion and the first sub-member first engaging portion is released during the movement of the engagement release member. In addition, the engagement release member second engaging portion makes contact with the first sub-member second engaging portion and the engagement release member second engaging portion pushes the first sub-member second engaging portion toward the upper direction. After that, when the engagement release member reaches to the first position, the pushing-up to the first sub-member second engaging portion due to the engagement release member second engaging portion is released and the first sub-member second engaging portion is moved toward the lower direction. As a result, the engagement release member second engaging portion is engaged with the first sub-member second engaging portion. In this state, the first sub-member can be separated from the main member.

An engagement release member according to the second aspect has a lateral engaging portion provided so as to protrude from an engagement release member main body toward the lateral direction. Further, the second sub-member has a second sub-member first engaging portion and a second sub-member second engaging portion. When the second sub-member is engaged with the main member, a bottom portion of the lateral engaging portion is engaged with the second sub-member first engaging portion. When the engagement release member is moved to the second position, an engagement between the lateral engaging portion and the second sub-member first engaging portion is released during the movement of the engagement release portion. Further, an upper portion of the lateral engaging portion makes contact with the second sub-member second engaging portion and the lateral engaging portion pushes the second sub-member second engaging portion toward the upper direction. After that, when the engagement release member reaches to the second position, the second sub-member second engaging portion is engaged with an opening portion provided in the upper portion of the lateral engaging portion. With this configuration, the pushing-up to the second sub-member second engaging portion due to the lateral engaging portion is released and the second sub-member second engaging portion is moved toward the lower direction. In this state, the second sub-member second engaging portion is moved toward the lower side. In this state, the second sub-member can be separated from the main member.

A medicine dispensing cassette according to a second aspect has a main body, a cover and a lock mechanism. The lock mechanism has an operating lever, an actuating force transmission lever, a shaft, an engaging portion and a biasing member. The operating lever can be operated through a hole formed in a bottom portion of the main body. When the operating lever is pivotally moved, the operating lever presses the actuating force transmission lever. With this operation, the actuating force transmission lever is pivotally moved. As a result, the shaft and the engaging portion are pivotally moved. Further, an engagement between the engaging portion and the cover is released by this pivotal movement. As a result, the lock of the cover is released. When the operation to the operating lever is released, the engaging portion is pivotally moved in a reverse direction by the biasing member and the cover is again engaged with the engaging portion in a case that the cover is closed. As a result, the cover is locked.

According to the present invention, it is possible to prevent improper medicines from being restocked into a medicine dispensing cassette. Further, according to the present invention, it is possible to easily disassemble and wash the medicine dispensing cassette.

BRIEF DESCRIPTION OF THE DRAWINGS

The present disclosure is described in conjunction with the appended figures:

In the appended figures, FIGS. 4 to 9 are mainly used for explaining a lock mechanism included in the medicine dispensing cassette.

On the other hand, FIGS. 10 to 16 are mainly used for explaining a disassembling operation of the medicine dispensing cassette.

Similarly in the appended figures, FIGS. 17 to 21 are mainly used for explaining a structure of an engagement release member included in the medicine dispensing cassette.

FIGS. 22 to 26 are used for explaining an operating principle of the engagement release member.

DETAILED DESCRIPTION OF THE INVENTION

§ 1 Outline of a Medicine Dispensing Apparatus

Figure 1:
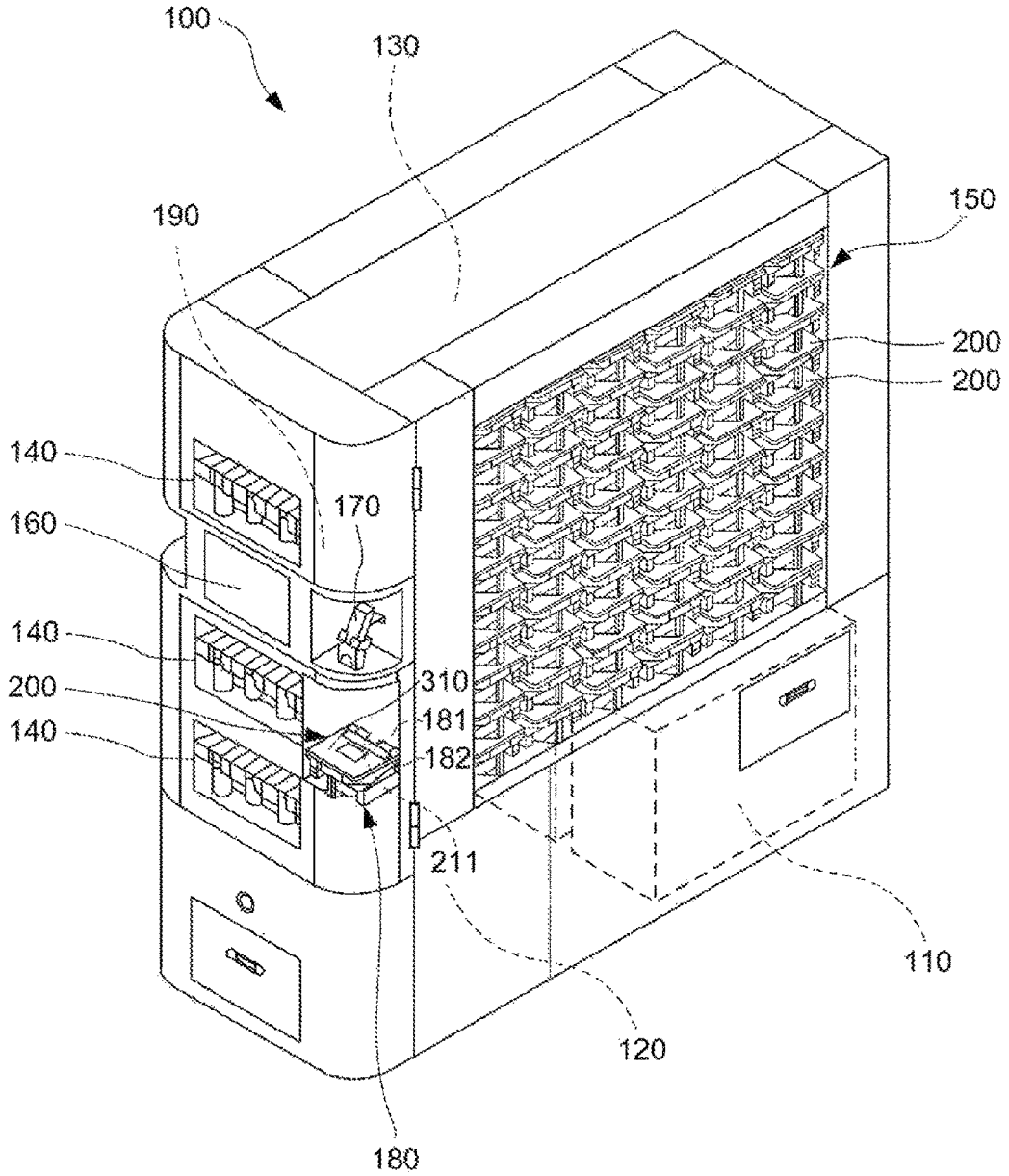
FIG. 1 is a perspective view showing an embodiment of a medicine dispensing apparatus.

FIG. 1 is a perspective view showing an embodiment of a medicine dispensing apparatus. A medicine dispensing apparatus 100 shown in this figure can dispense prescribed medicines into a vial bottle by a prescribed number based on inputted prescription information. This medicine dispensing apparatus 100 has a vial bottle supplying device 110, a labeling device 120, a vial bottle carrying device 130 and discharge ports 140. Further, the medicine dispensing apparatus 100 has cassette placing portions 150 on lateral surfaces thereof. In addition, the medicine dispensing apparatus 100 has a touch panel display 160, an optical scanner 170 and a medicine restocking portion 180 at a front surface thereof. Further, the medicine dispensing apparatus 100 has a control device 190 therein.

Details of this medicine dispensing apparatus 100 are disclosed in WO 2010/110360. In addition, details of a mechanism for allowing cassettes attached to the cassette placing portions 150 to dispense the medicines are disclosed in WO 2013/035692. Thus, an outline of the medicine dispensing apparatus 100 will be only briefly explained in the following description.

As shown in FIG. 1, the vial bottle supplying device 110 is provided in the medicine dispensing apparatus 100 on the lower and rear side of the medicine dispensing apparatus 100. This vial bottle supplying apparatus 110 additionally has a function of storing a plurality of vial bottles. The labeling device 120 is provided in the medicine dispensing apparatus 100 on the lower and front side of the medicine dispensing apparatus 100. The cassette placing portions 150 are respectively provided on the both lateral surfaces of the medicine dispensing apparatus 100 on the upper side of the medicine dispensing apparatus 100. A plurality of medicine dispensing cassettes (also referred to as "container") 200 are arranged in a matrix in these cassette placing portions 150. The medicines dispensed by the medicine dispensing apparatus 100 are stored in these medicine dispensing cassettes 200. The vial bottle carrying device 130 is provided between the cassette plating portion 150 and the cassette placing portion 150, that is provided in the medicine dispensing apparatus 100 on the upper side of the medicine dispensing apparatus 100. Further, the plurality of discharging ports 140 (in the example shown in FIG. 1, the number of the discharging ports 140 is three) are provided on the front surface of the medicine dispensing apparatus 100.

The touch panel display 160 has both functions as a display device and an input device. The optical scanner 170 can read an optical scanner readable symbol such as a barcode and a two-dimensional code. The control device 190 controls operations of various devices included in the medicine dispensing apparatus 100 based on input information received from the touch panel display 160, the optical scanner 170 or the like.

When the medicine dispensing apparatus 100 dispenses the medicines, the optical scanner 170 first scans a symbol attached to a prescription to obtain prescription information for the prescription. When the medicine dispensing apparatus 100 receives the prescription information and receives an input for dispensing the medicines from a prescription professional, the vial bottle supplying device 110 first supplies a vial bottle to the labeling device 120. Next, the labeling device 120 prints out a label based on the inputted prescription information and attaches this label to the vial bottle. After that, the vial bottle carrying device 130 carries the vial bottle to which the label has been attached in the vicinity of the medicine dispensing cassette 200 in which the prescribed medicines are contained. Then, the medicine dispensing cassette 200 dispenses the prescribed medicines into the vial bottle by a prescribed number. When the prescribed medicines are restocked in the vial bottle, the vial bottle carrying device 130 carries the vial bottle to the discharging port 140. Then, the vial bottle discharged from the discharging port 140 is taken by the prescription professional such as a pharmacist and a technician.

While the medicine dispensing apparatus 100 is dispensing the medicines, one of the medicine dispensing cassettes 200 becomes empty in the course of time. In this case, the prescription professional needs to restock new medicines into this medicine dispensing cassette 200. However, in the medicine dispensing cassette 200, a cover 310 of the cassette is locked and the cover 310 cannot be opened in normal times. Thus, at the time of restocking the medicines, the prescription professional needs to perform a predefined operation for releasing the lock of the cover 310. Regarding this operation, details of this operation are described in JP 2014-222313. Thus, the operation is only briefly explained in the following description.

Figure 3:
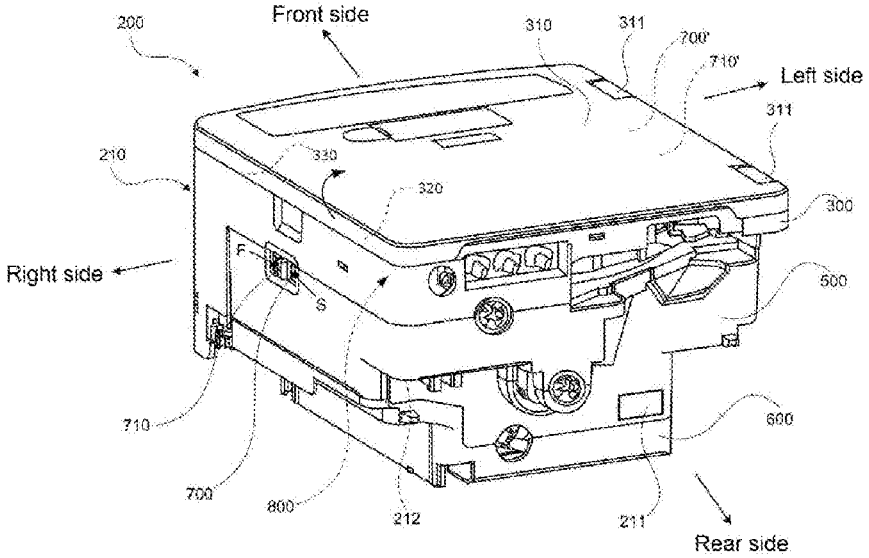
FIG. 3 is a perspective view of the medicine dispensing cassette. In this regard, this figure is a view of the medicine dispensing cassette seen from a rear and right side.

First, the prescription professional places the medicine dispensing cassette 200 desired to be restocked onto the medicine restocking portion 180. As shown in FIG. 3, an RF tag 211 is provided on a main body 210 of the medicine dispensing cassette 200 as an identification indicator used for identifying the medicine dispensing cassette 200. Referring back to FIG. 1, the medicine dispensing apparatus 100 includes an RF tag reading device 181 at the medicine supplying portion 180. Thus, when the medicine dispensing cassette 200 is placed onto the medicine restocking portion 180, the medicine dispensing apparatus 100 can identify the medicine dispensing cassette 200 placed on the medicine restocking portion 180 through the RF tag reading device 181. Further, the medicine dispensing apparatus 100 internally stores information on the medicines contained in each medicine dispensing cassette 200. Thus, the medicine dispensing apparatus 100 can identify the medicines to be restocked into the medicine dispensing cassette 200 placed on the medicine restocking portion 180 based on this information.

The prescription professional fetches a bottle in which the medicines desired to be restocked from a medicine storage or the like at the time of restocking the medicines. Normally, an optical scanner readable symbol such as a barcode is attached to a label of the bottle. The prescription professional uses the optical scanner 170 to read this symbol. With this operation, the medicine dispensing apparatus 100 can identify the medicines contained in this bottle. The medicine dispensing apparatus 100 has a lock release device 182 for releasing the lock of the cover 310 of the medicine dispensing cassette 200 at the medicine supplying portion 180. Only in a case that the medicines contained in the bottle whose symbol is scanned is proper as the medicines to be restocked into the medicine dispensing cassette 200, the medicine dispensing apparatus 100 drives the lock release device 182 to release the lock of the cover 310 of the medicine dispensing cassette 200. With this operation, the prescription professional can open the cover 310 to restock the new medicines into the medicine dispensing cassette 200. The medicine dispensing cassette 200 of this embodiment has one of characteristics in a lock mechanism for locking the cover 310. Hereinafter, the medicine dispensing cassette 200 will be described in detail as well as this lock mechanism.

§ 2 Outline 1 of the Medicine Dispensing Cassette 200

Figure 2:
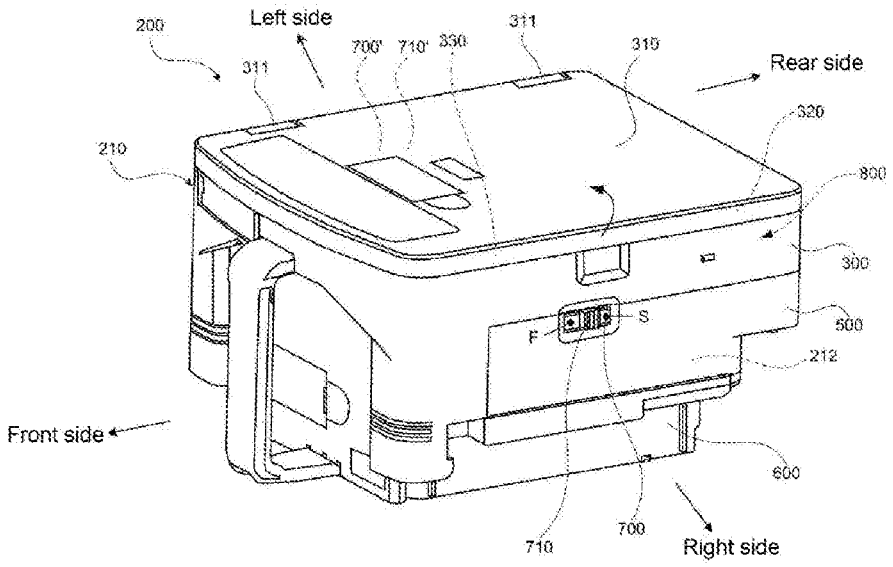
FIG. 2 is a perspective view of a medicine dispensing cassette included in the medicine dispensing apparatus. In this regard, this figure is a view of the medicine dispensing cassette seen from a front and right side.

Each of FIGS. 2 and 3 is a perspective view of the medicine dispensing cassette 200. In this regard, FIG. 2 is a view of the medicine dispensing cassette 200 seen from the front and right side and FIG. 3 is a view of the medicine dispensing cassette 200 seen from rear and right side. When the medicine dispensing cassette 200 is set in the medicine dispensing apparatus 100, a surface directed toward an outside of the medicine dispensing apparatus 100 is referred to as "front surface" and a surface directed toward an inside of the medicine dispensing apparatus 100 is referred to as "rear surface" in this specification for the purpose of illustration. Further, a portion positioned on the right side when the medicine dispensing cassette 200 is seen from the front side is referred to as "right side" and a portion positioned on the left side when the medicine dispensing cassette 200 is seen from the front side.

As shown in FIGS. 2 and 3, in the medicine dispensing cassette 200, the cover 310 is attached to an upper surface of the main body 210. The cover 310 is hinged to the main body 210 at a left end of the cover 310 with a hinge 311. Thus, when the lock of the cover 310 is released, the cover 310 can be pivotally moved around the hinge 311 and opened. In other words, when the lock of the cover 310 is released, the cover 310 can be opened so that a right end of the cover 310 is moved toward the upper side.

Figure 4:
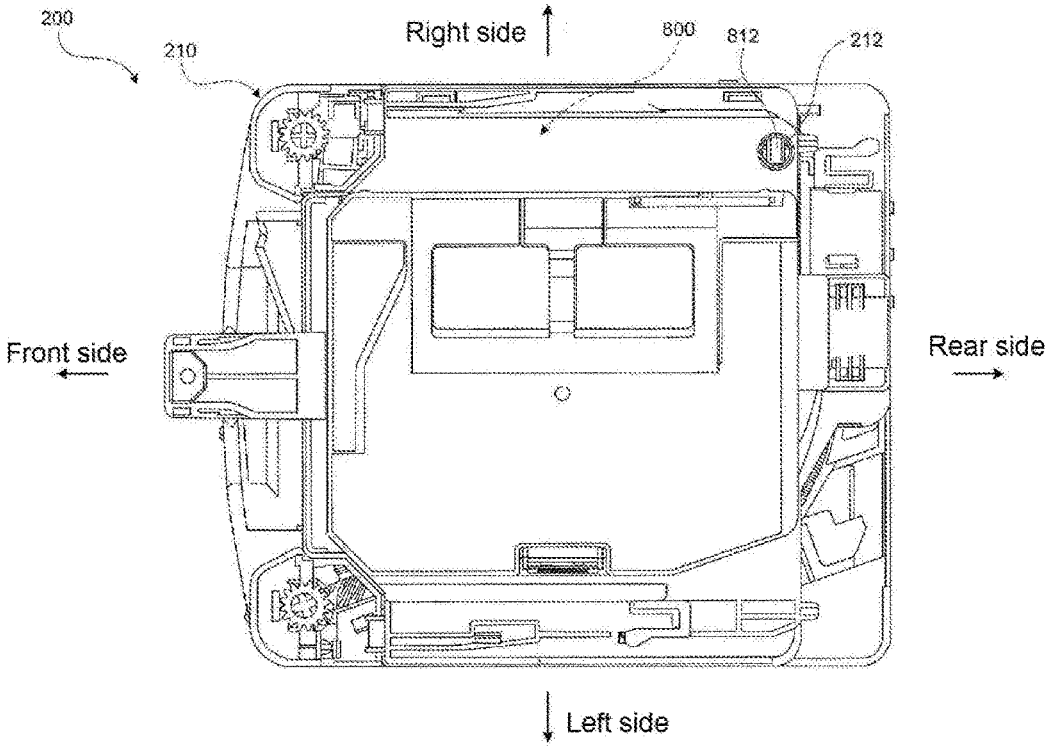
FIG. 4 is a bottom view of the medicine dispensing cassette.

The medicine dispensing cassette 200 internally has a lock mechanism 800 for locking the cover 310. FIG. 4 is a bottom view of the medicine dispensing cassette 200. Namely, FIG. 4 is a view of the medicine dispensing cassette 200 seen from the lower side toward the upper side. As shown in this figure, a hole 212 is formed in a bottom surface of the main body 210. More specifically, the hole 212 is formed on the right side on the bottom surface of the main body 210 and in the vicinity of the rear surface of the main body 210 and opened toward the vertical direction. The lock release device 182 of the medicine dispensing apparatus 100 (see FIG. 1) includes a rod (not shown in the drawings) and this rod is configured so that the rod can be inserted into the hole 212. Further, the lock release device 182 operates the rock mechanism 800 with using this rod to release the lock of the cover 310. By forming the hole 212 in the bottom surface of the main body 210 as shown in this embodiment, it becomes easier to construct the lock release device 182. In addition, a user cannot easily release the lock of the lock mechanism 800.

§ 2.1 Structure of the Cover 310

Figure 5A:
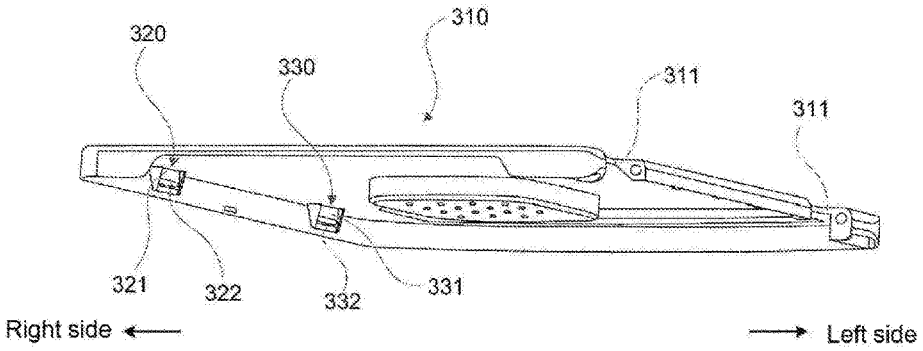
FIG. 5A is a perspective view of a cover included in the medicine dispensing cassette. In this regard, this figure is a view of the cover seen from a lower and rear side.
Figure 5B:
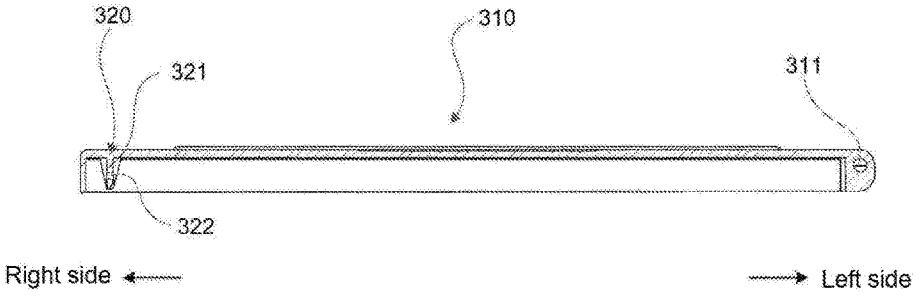
FIG. 5B is a cross-sectional rear view of the cover. In this regard, this figure is a view of the cover seen from a rear side toward a front side.

FIG. 5A is a perspective view of the cover 310 seen from the lower side and FIG. 5B is a vertical cross-sectional view of the cover 310. In this regard, it should be noted that FIG. 5B is a view of the cover 310 seen from the rear side toward the front side. As shown in these figures, a first engaging portion 320 and a second engaging portion 330 are provided in the vicinity of the right-side end portion of the cover 310, that is in the vicinity of the end portion opposite to the hinge 311. The first engaging portion 320 and the second engaging portion 330 are engaged with the lock mechanism 800. The first engaging portion 320 is constituted of a first protruding portion 321 protruding from a bottom surface of the cover 310 toward the lower direction and a first slit 322 formed in the first protruding portion 321. In the same manner, the second engaging portion 330 is also constituted of a second protruding portion 331 protruding from the bottom surface of the cover 310 toward the lower direction and a second slit 332 formed in the second protruding portion 331. The first slit 322 and the second slit 332 extend in a front-rear direction and their opening portions are opened toward the left-right direction.

§ 2.2 Structure of the Lock Mechanism 800

Figure 6:
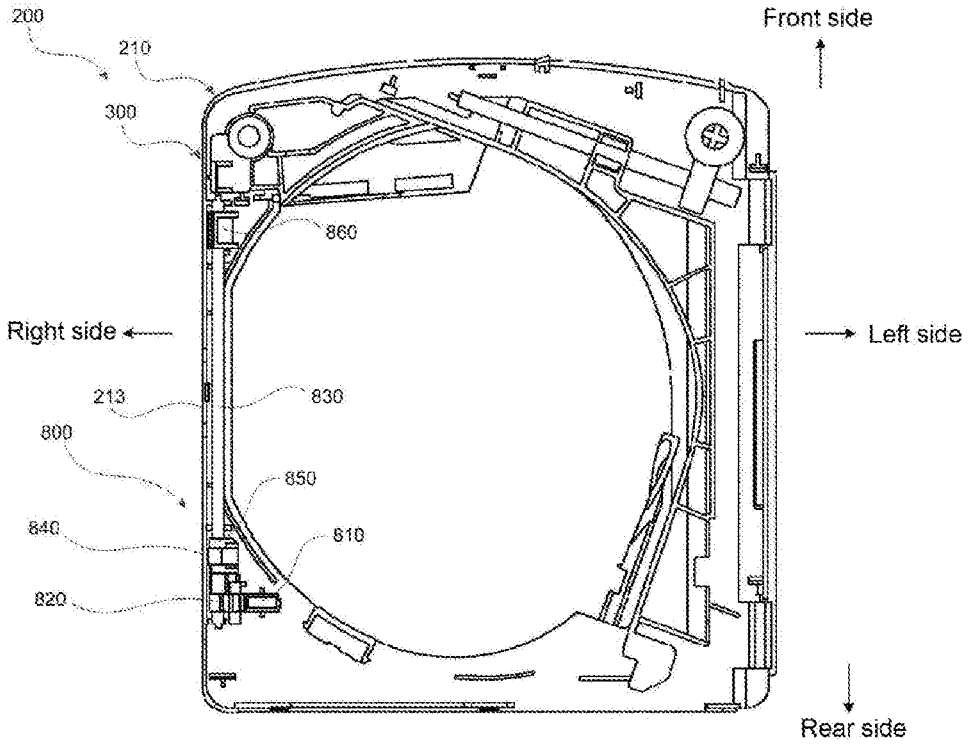
FIG. 6 is a bottom view of a member constituting a main body of the medicine dispensing cassette.

FIG. 6 is a view of an inside of the main body 210 seen from the lower side toward the upper side. In a strict sense, as described later, the main body 210 is constituted of a main member 500, a first sub-member 300 and a third sub-member 600 as shown in FIG. 2. FIG. 6 is a view of the first sub-member 300 seen from the lower side toward the upper side in a state that a bottom portion cover of the first sub-member 300 is removed. As shown in this figure, the lock mechanism 800 is provided in the main body 210. More specifically, the lock mechanism 800 is provided on an upper portion of the main body 210 and in the vicinity of a right-side lateral surface of the main body 210.

Figure 7:
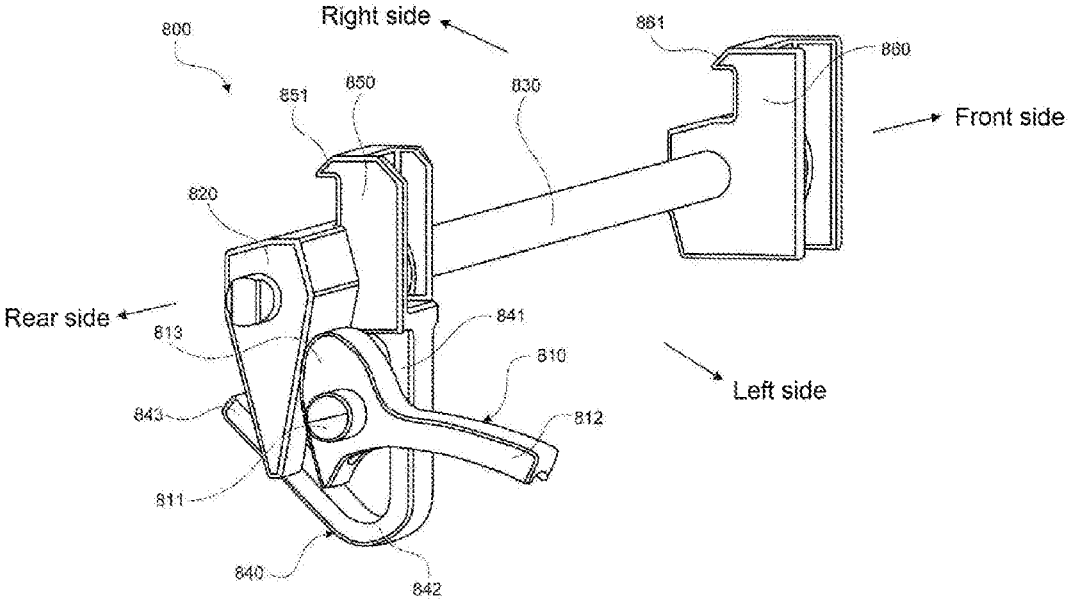
FIG. 7 is a perspective view of the lock mechanism included in the medicine dispensing cassette.

FIG. 7 is a perspective view showing the lock mechanism 800. As shown in this figure, the lock mechanism 800 has an operating lever 810, an actuating force transmission lever 820, a shaft 830, a biasing member 840, a first engaging member 850 and a second engaging member 860. The second engaging member 860 is attached in the vicinity of a front-side end portion of the shaft 830. The actuating force transmission lever 820, the first engaging member 850 and the biasing member 840 are integrally formed from one material (such as a resin). With this configuration, it becomes easier to produce the lock mechanism 800 and assemble the medicine dispensing cassette 200. The integrated body constituted of the actuating force transmission lever 820, the first engaging member 850 and the biasing member 840 is attached in the vicinity of a rear-side end portion of the shaft 830. More specifically, the first engaging member 850 is integrated with a front-side end surface of the actuating force transmission lever 820. Further, the biasing member 840 is integrated with a lower portion of the first engaging member 850. The operating lever 810 is provided so as to make contact with the actuating force transmission lever 820.

As shown in FIG. 6, the shaft 830 is horizontally arranged in the vicinity of a right-side inner wall 213 of the main body 210 so as to be directed toward the front-rear direction, that is so as to be in parallel with the cover 310. Thus, the shaft 830 is directed toward a direction perpendicular to a central axis of the hole 212 (see FIG. 4). As shown in FIG. 7, the first engaging member 850 and the second engaging member 860 are arranged so as to be directed toward the upper direction in an initial state (a state that the operating lever 810 is not operated). A first click 851 is formed on a tip end portion of the first engaging member 850 so as to be directed toward the right-side inner wall 213 of the main body 210. In the same manner, a second click 861 is formed on a tip end portion of the second engaging member 860 so as to be directed toward the right-side inner wall 213 of the main body 210. The actuating force transmission lever 820 is formed so as to protrude toward a direction opposite to the first engaging member 850. Thus, the actuating force transmission lever 820 is directed toward the lower direction in the initial state. Further, the biasing member 840 is formed so as to protrude from the lower portion of the first engaging member 850 toward the lower direction. This biasing member 840 biases the first engaging member 850 in a direction in which the first engaging member 850 which is in a laid state stands up. In other words, the biasing member 840 biases the first engaging member 850 to rotate the first engaging member 850 in a direction for allowing the first member 850 to be engaged with the cover 310.

Figure 8:
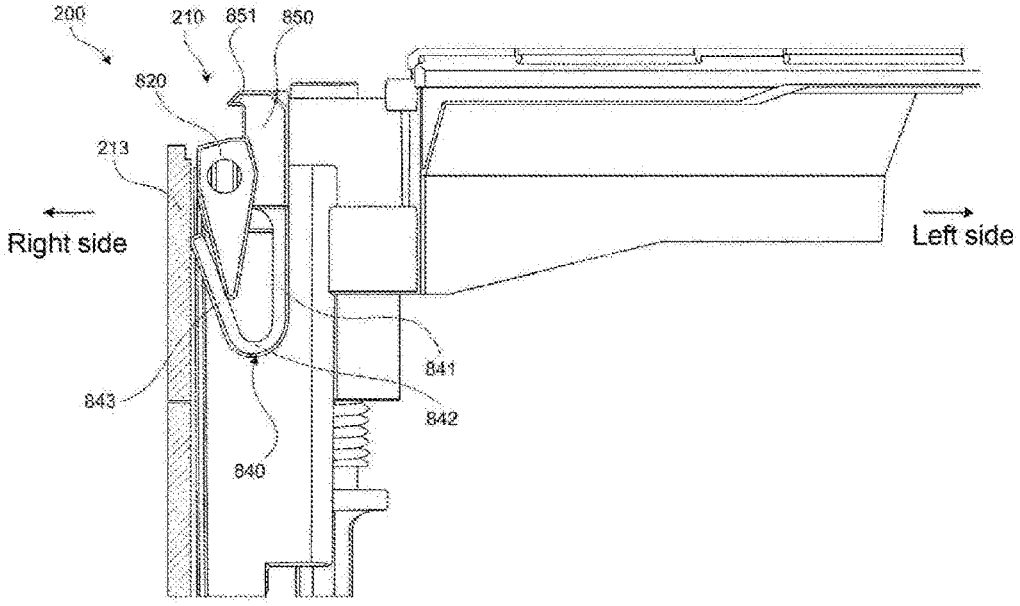
FIG. 8 is a cross-sectional rear view in the vicinity of the lock mechanism in the medicine dispensing cassette. In this regard, this figure is a view of the lock mechanism seen from a rear side toward a front side of the medicine dispensing cassette.

As shown in FIG. 8, the biasing member 840 is constituted of a plate-like material having a substantially V or U shape, that is a leaf spring. Thus, the biasing member 840 has a base end portion 841, a bent portion 842 and a tip end portion 843. The base end portion 841 straight extends from a lower end portion of the first engaging member 850 toward the lower direction. Further, the biasing member 840 is sharply bent at the bent portion 842. Thus, the tip end portion 843 straight extends toward a diagonal upper direction. Further, a tip end of the tip end portion 843 makes contact with the right-side inner wall 213 of the main body 210.

As shown in FIG. 6, the operating lever 810 is attached to the main body 210 so as to be positioned in the vicinity of the actuating force transmission lever 820. As shown in FIG. 7, a structure of the operating lever 810 is similar to a structure in which a bar protrudes from an eccentric cam.

The operating lever 810 has a fulcrum point portion 811, a force point portion 812 and a working point portion 813. The fulcrum point portion 811 constitutes a pivotal center of the operating lever 810 and its rotating axis is in parallel with the shaft 830 and directed toward a direction perpendicular to the central axis of the hole 212. The force point portion 812 is constituted of a protruding bar portion and positioned on the vertical upper side of the hole 212 as shown in FIG. 4. As shown in FIG. 7, this force point portion 812 is directed toward the horizontal direction in the initial state, that is a direction perpendicular to the central axis of the hole 212 in the initial state. The forcing point portion 812 protrudes in a separating direction from the actuating force transmission lever 820. The working point portion 813 is constituted of an eccentric cam. An end surface in parallel with a rotating center of the working point portion 813 makes contact with the actuating force transmission lever 820. More particularly, the end surface of the working point portion 813 makes contact with an end surface in parallel with a rotating center of the actuating force transmission lever 820.

Figure 9A:
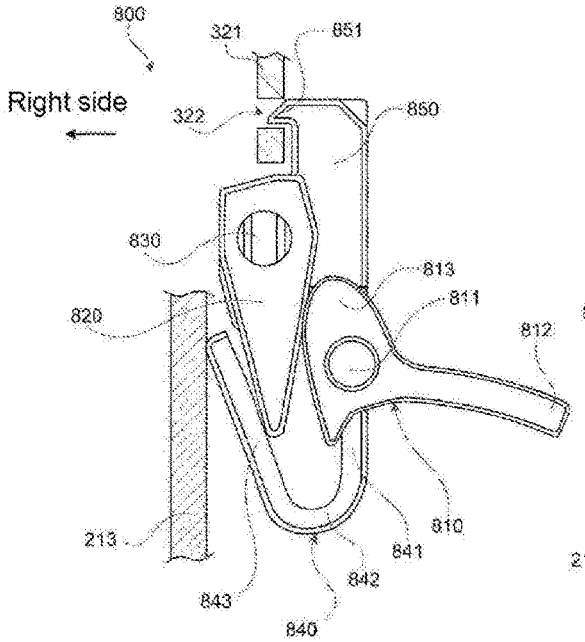
FIG. 9 is a schematic view for explaining a mechanism for allowing the lock mechanism to lock/unlock the cover.

FIG. 9 is a schematic view for explaining a mechanism for allowing the lock mechanism 800 to lock/unlock the cover 310. As shown in FIG. 9A, in the initial state, the first engaging member 850 is in a stood-up state and directed toward the upper direction due to biasing force of the biasing member 840. Thus, the first click 851 is directed toward the horizontal direction. Further, the first click 851 is fitted in the first slit 322 (see FIG. 5) formed in the cover 310 in this state. In this regard, although this matter is not shown in FIG. 9, the same can be applied to the second engaging member 860. Namely, the second click 861 is also fitted in the second slit 332 (see FIG. 5) formed in the cover 310. Thus, the cover 310 is locked and the user cannot open the cover 310.

Figure 9B:
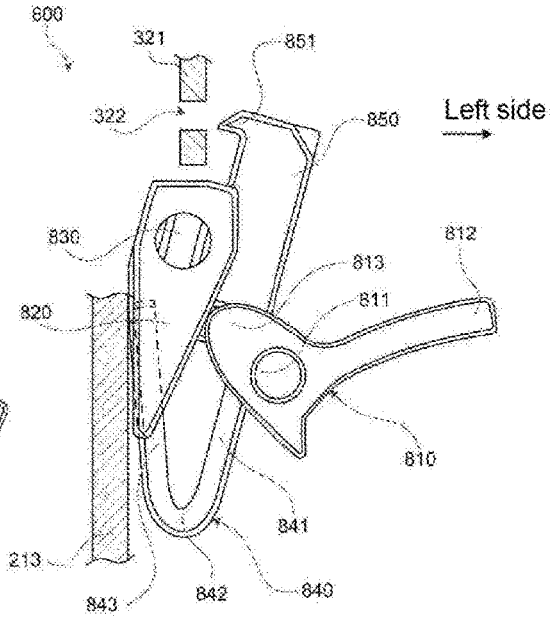

As described above, the lock release device 182 of the medicine dispensing apparatus 100 can push the force point portion 812 of the operating lever 810 toward the upper side through the hole 212 (see FIG. 4). As a result, the operating lever 810 can pivotally move around the fulcrum point portion 811 against the biasing force of the biasing member 840 as shown in FIG. 9B. With this operation, the working point portion 813 is moved in the direction toward the right-side inner wall 213 of the main body 210 and thus the end surface of the working point portion 813 presses the end surface of the actuating force transmission lever 820. As a result, the actuating force transmission lever 820 is moved in the direction toward the right-side inner wall 213 of the main body 210. Namely, the actuating force transmission lever 820 is pivotally moved in a direction allowing the actuating force transmission lever 820 to be directed toward the lateral side. With this pivotal movement, the shaft 830, the first engaging member 850 and the second engaging member 860 are also pivotally moved integrally with each other. Specifically, the first engaging member 850 and the second engaging member 860 are pivotally moved in a direction for allowing the first engaging member 850 and the second engaging member 860 to be laid. As a result, the first click 851 is separated from the first slit 322 as shown in FIG. 9B. In the same manner, although this matter is not shown in the drawings, the second click 861 is also separated from the second slit 332. With this configuration, the engagements among the first click 851, the second click 861, the first slit 322 and the second slit 332 are released. As a result, the lock of the cover 310 is released and the user becomes possible to open the cover 310.

As described above, the first engaging member 850 is biased by the biasing member 840 in the direction for allowing the first engaging member 850 to stand up. More specifically, a bend angle of the bent portion 842 becomes small in a state that the first engaging member 850 is inclined with respect to the right-side inner wall 213. Elastic force for making the bend angle larger occurs in the bent portion 842 in this state. Thus, when the lock release device 182 releases the pushing-up to the force point portion 812, the lock mechanism 800 returns to the state as shown in FIG. 9A. Specifically, when the lock release device 182 releases the pushing-up to the force point portion 812, the first engaging member 850 stands up due to the biasing force of the biasing member 840. More particularly, when the pushing-up to the force point portion 812 is released, a space between the base end portion 841 and the tip end portion 843 is enlarged and thus the biasing member 840 pivotally moves the first engaging member 850 in the direction toward the right-side inner wall 213 of the main body 210. Further, the shaft 830, the second engaging member 860 and the actuating force transmission lever 820 are also pivotally moved along with this pivotal movement of the first engaging member 850. As a result, the second engaging member 860 also stands up as is the case with the first engaging member 850. Further, the actuating force transmission lever 820 is directed toward the lower direction. Furthermore, the actuating force transmission lever 820 presses the working point portion 813 of the operating lever 810. As a result, the operating lever 810 is also pivotally moved and the operating lever 810 is directed toward the horizontal direction. As shown in FIG. 9A, when the cover 310 is closed, the first click 851 and the second click 861 are respectively fitted into the first slit 322 and the second slit 332 due to the standing-up of the first engaging member 850 and the second engaging member 860. As a result, the cover 310 is locked and the user cannot open the cover 310. Further, when the cover 310 is closed in a state that the first engaging member 850 and the second engaging member 860 stand up, the first protruding portion 321 and the second protruding portion 331 press inclined planes respectively formed on upper surfaces of the first click 851 and the second click 861. As a result, the first click 851 and the second click 861 are pivotally moved slightly in a direction for allowing the first click 851 and the second click 861 to be laid. After that, when heights of the first slit 322 and the second slit 332 coincide with heights of the first click 851 and the second click 561, the first click 851 and the second click 861 are pivotally moved slightly by the biasing force of the biasing member 840 in the direction for allowing the first click 851 and the second click 861 to stand up. As a result, the first click 851 and the second click 861 are respectively fitted into the first slit 322 and the second slit 332.

§ 2.3 Advantage 1 of the Medicine Dispensing Cassette 200

The above-described medicine dispensing cassette 200 is configured so that the medicine dispensing apparatus 100 can release the lock of the cover 310 and the user cannot easily release the lock. Thus, when the medicine dispensing cassette 200 is used in the medicine dispensing apparatus 100, it is possible to prevent improper medicines from being restocked into the empty medicine dispensing cassette 200 at the time of restocking the medicines into the empty medicine dispensing cassette 200. This is caused by the configuration that the medicine dispensing apparatus 100 scans the barcode attached to the label of the bottle in which the medicines to be restocked are contained and releases the lock of the cover 310 only in the case that the medicines contained in the bottle are proper as the medicines to be stocked. With this configuration, specifications of the medicine dispensing apparatus 100 of the above-described embodiment can be closed-loop specifications in the United States. In the closed-loop specifications, the prescription professional can omit a visual inspection with respect to the medicines dispensed by the medicine dispensing apparatus 100 based on the prescription information. In addition, in the case of the closed-loop, it is accepted that the medicine dispensing apparatus 100 dispenses the vial bottle in a state that an aperture of the vial bottle is sealed. In this case, it is possible to promptly confirm that the seal is opened once unlike a normal cap. Thus, it is possible to easily confirm whether or not the vial bottle in which the medicines dispensed by the medicine dispensing apparatus 100 are contained is opened by a third party.

§ 3 Outline 2 of the Medicine Dispensing Cassette 200

Another big one of the characteristics of the medicine dispensing cassette 200 of this embodiment is that the user can easily disassemble the medicine dispensing cassette 200 into a plurality of members. Further, it goes without saying that the assembling of the medicine dispensing cassette 200 after disassembling the medicine dispensing cassette 200 is also easy. As shown in FIG. 2, the medicine dispensing cassette 200 has a pair of a first engagement release member 700 and a second engagement release member 700' in the vicinity of an inner lateral surface. More specifically, the first engagement release member 700 is provided in the vicinity of the right-side lateral surface of the main body 210 and the second engagement release member 700' is provided in the vicinity of a left-side lateral surface of the main body 210. The first engagement release member 700 and the second engagement release member 700' respectively have operating portions 710 and 710'. These operating portion 710 and 710' are exposed on the outside of the main body 210. The user can operate these operating portion 710 and 710' to disassemble the medicine dispensing cassette 200.

As shown in FIG. 2, the main body 210 is constituted of three members, that is a main member 500, a first sub-member 300 and a third sub-member 600. The third sub-member 600 is engaged with a bottom portion of the main member 500. Thus, the third sub-member 600 can be also referred to as a lower level member 600. The first sub-member 300 is engaged with an upper portion of the main member 500. Thus, the first sub-member 300 can be also referred to as an upper level member 600. The first engagement release member 700 and the second engagement release member 700' are provided in the main member 500. Further, the cover 310 is attached to an upper portion of the first sub-member 300.

Figure 10:
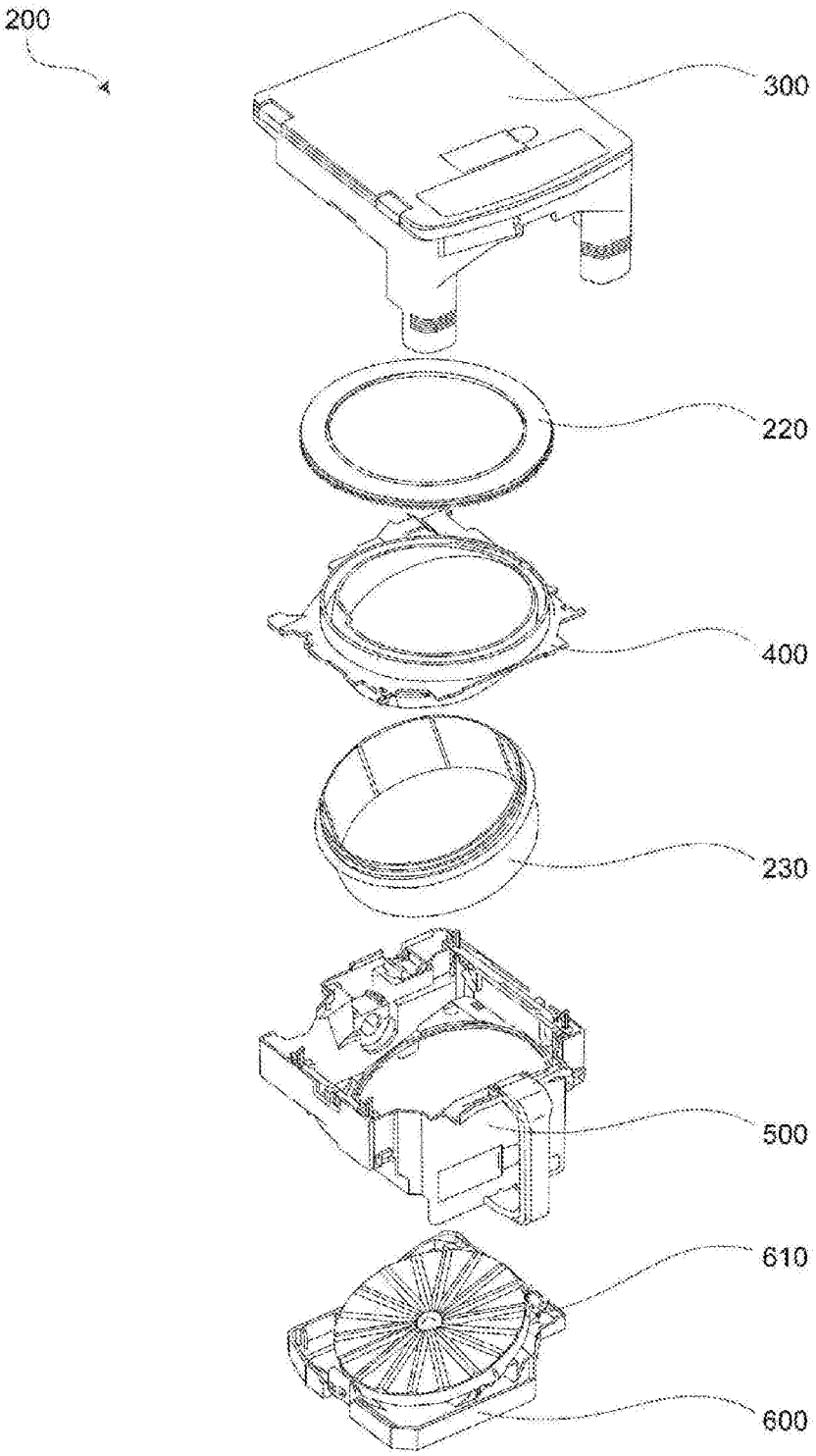
FIG. 10 is an exploded perspective view of the medicine dispensing cassette.
Figure 11:
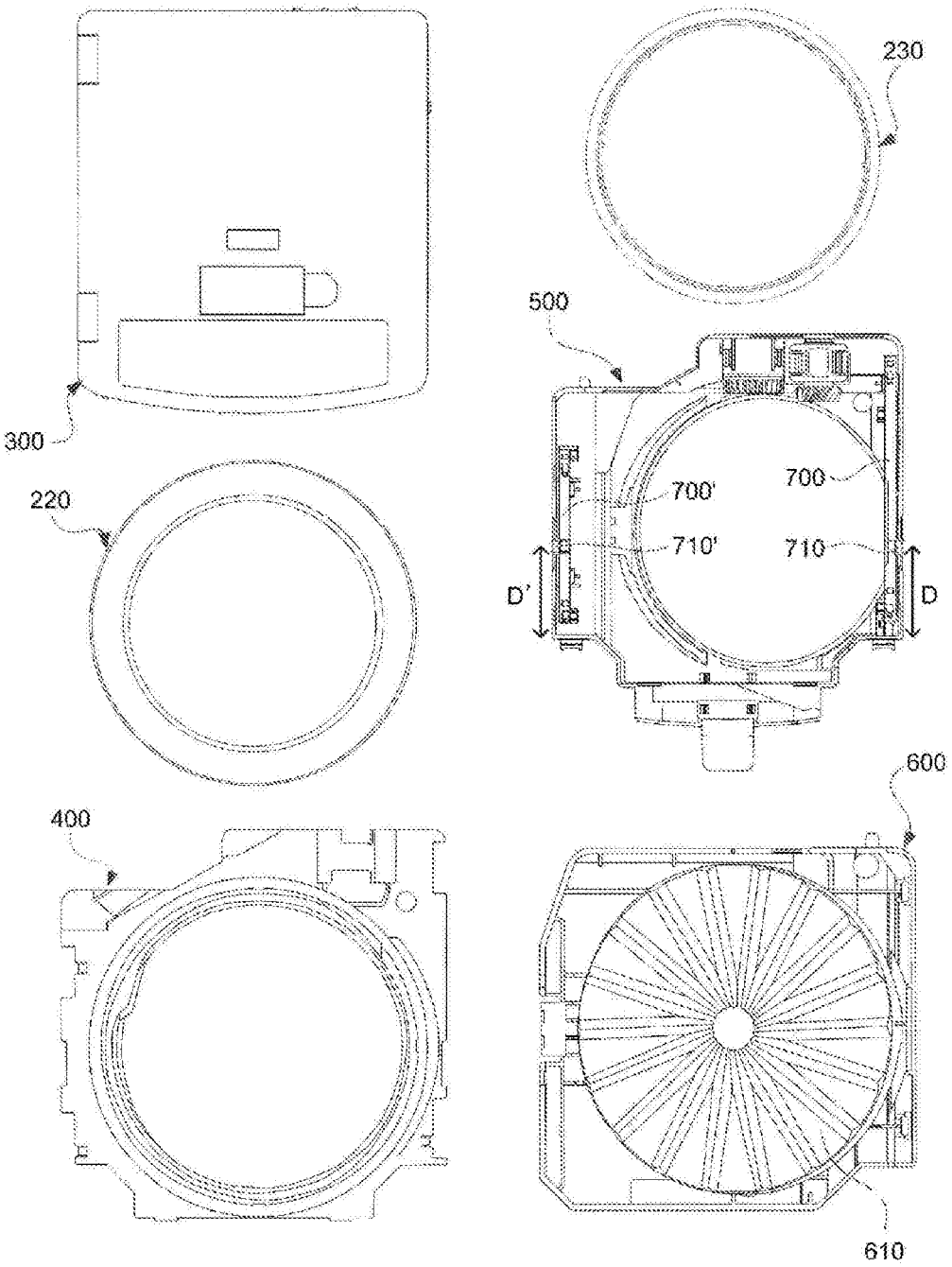
FIG. 11 is a planar view of each member of the medicine dispensing cassette which is in a disassembled state.

FIG. 10 is an exploded perspective view of the medicine dispensing cassette 200. Further, FIG. 11 is a planar view of each disassembled member. As is clear from these figures, the medicine dispensing cassette 200 internally has a first rotating body 220, a second sub-member 400, a cylindrical member 230 and a second rotating body 610 in addition to the main member 500, the first sub-member 300 and the third sub-member 600. Thus, the user can disassemble the medicine dispensing cassette 200 into the first sub-member 300, the first rotating body 220, the second sub-member 400, the cylindrical member 230, the main member 500, the second rotating body 610 and the third sub-member 600.

The second sub-member 400 partitions between the main member 500 and the first sub-member 300. Thus, the second sub-member 400 can be also referred to as a partition member 400. The first rotating body 200 is a member for aligning the medicines in line. In the medicine dispensing cassette 200, the first rotating body 220 and the second rotating body 610 are rotated at the time of dispensing the medicines and the medicines are first supplied to the first rotating body 220 from the second rotating body 610. At this time, movement of the medicines is restricted by the cylindrical member 230 so as to prevent the medicines from being carried to a place other than the first rotating body 220. At the time when the medicines are supplied to the first rotating body 220, the medicines are overlapped with each other in the vertical direction and/or arranged in the horizontal direction. The first rotating body 220 cooperates with the other members with being rotating to dissolve this overlapping and arrangement. After that, the medicines are discharged outside the medicine dispensing cassette 200 one by one by the rotation of the first rotating body 220. At this time, the medicine dispensing apparatus 100 counts the number of the dispensed medicines. In this regard, details of this mechanism are disclosed in WO 2012/099189.

§ 3.1 Disassembling Procedure for the Medicine Dispensing Cassette 200

Figure 12:
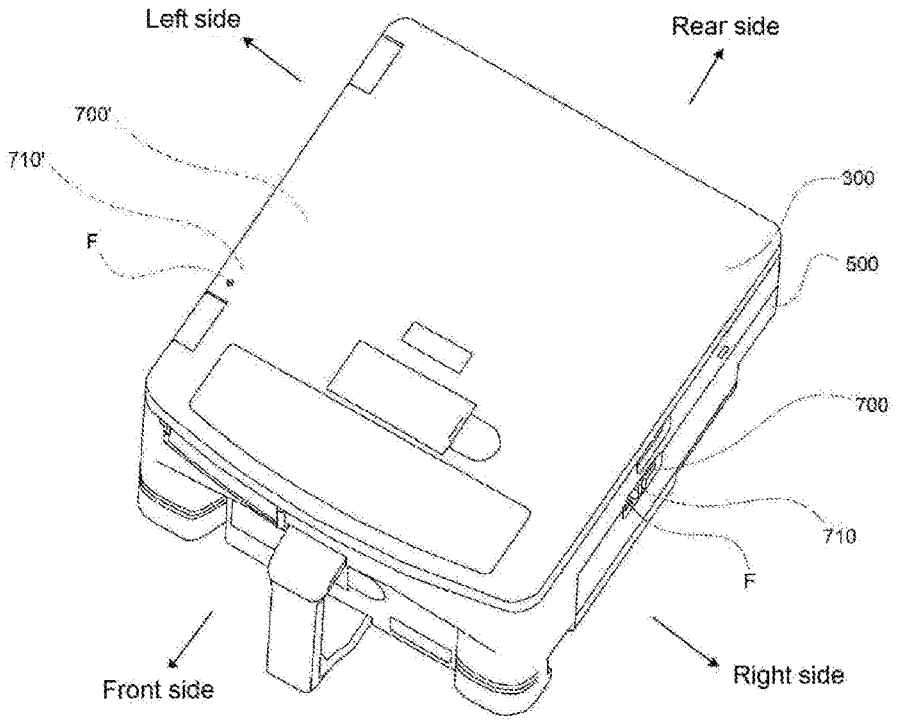
FIG. 12 is a perspective view showing a state before a first sub-member is removed from the medicine dispensing cassette.
Figure 13:
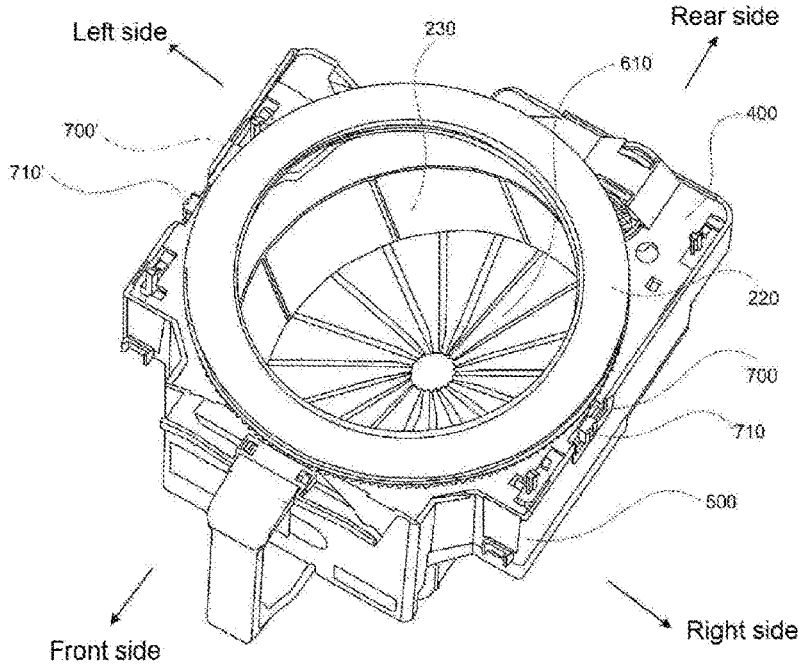
FIG. 13 is a perspective view showing a state after the first sub-member is removed from the medicine dispensing cassette.

Hereinafter, a procedure for disassembling the medicine dispensing cassette 200 will be described based on FIGS. 12 to 16. First, the user pulls the operating portions 710 and 710' toward the front side as shown in FIG. 12 to move the first engagement release member 700 and the second engagement release member 700' to a first position F. Then, the engagement between the main member 500 and the first sub-member 300 is released. As a result, the first sub-member 300 is removed from the main member 500 only by pulling out the first sub-member 300 toward the upper direction as shown in FIG. 13. In this case, the first rotating body 220 is exposed on the outside. FIG. 13 shows a state after the first sub-member 300 is removed from the main member 500. As is clear from this figure, the first rotating body 220 is merely placed on the main member 500. More particularly, the first sub-member 300 merely restricts the position of the first rotating body 200 so that the first rotating body 220 cannot be removed. Thus, it is possible to easily remove the first rotating body 220 from the main member 500 by only gripping and pulling up the first rotating body 200 after the first sub-member 300 has been removed.

Figure 14:
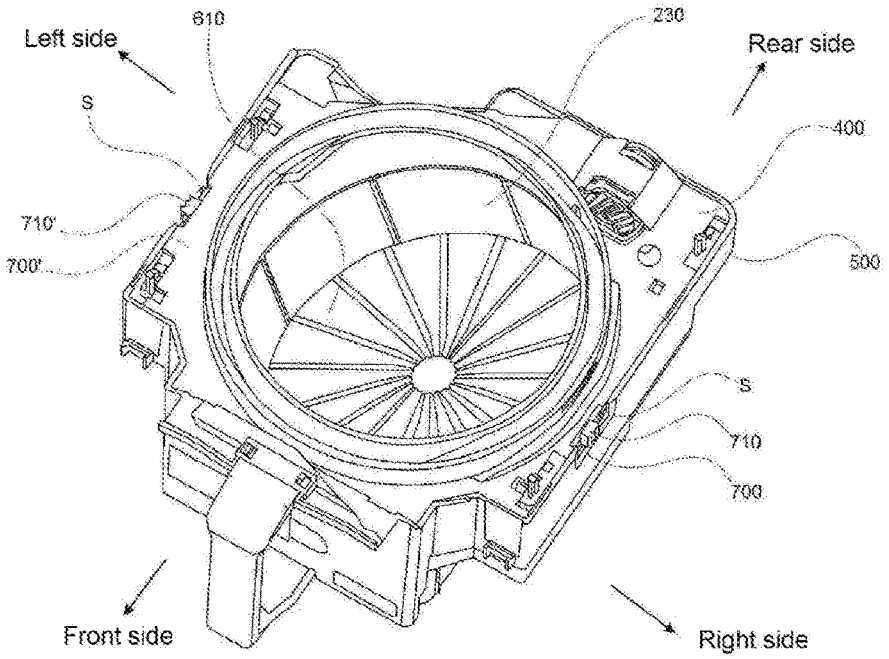
FIG. 14 is a perspective view showing a state before a second sub-member is removed from the medicine dispensing cassette.
Figure 15:
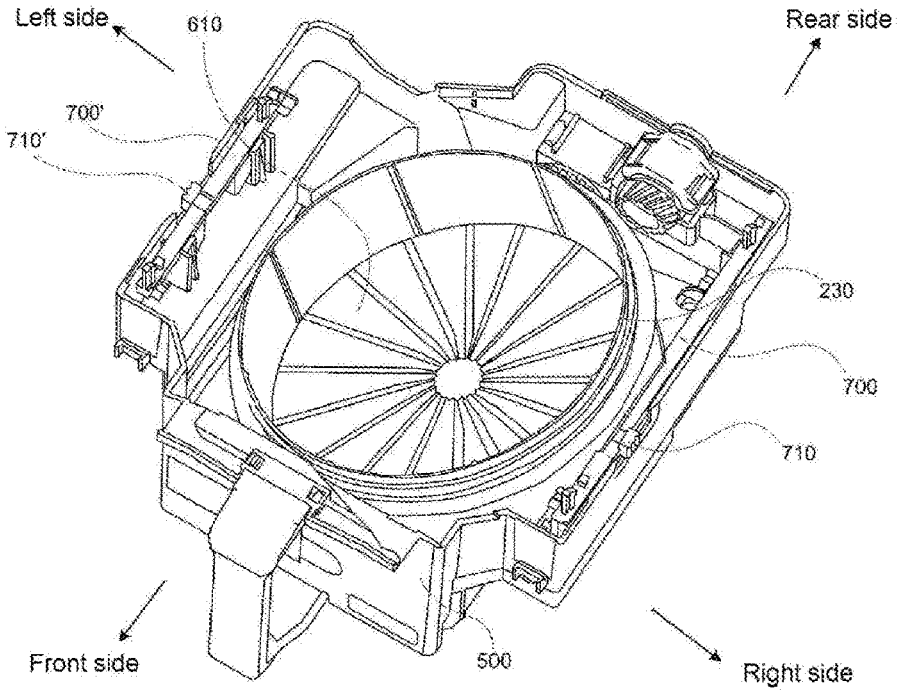
FIG. 15 is a perspective view showing a state that the second sub-member is removed from the medicine dispensing cassette.

FIG. 14 shows a state after the first rotating body 220 is removed from the main member 500. As shown in this figure, when the first rotating body 220 is removed from the main member 500, the second sub-member 400 is exposed toward the upper direction. In this state, the user pushes the operating portions 710 and 710' toward the rear side to move the first engagement release member 700 and the second engagement release member 700' to a second position S. Then, the engagement between the main member 500 and the second sub-member 400 is released. As a result, the second sub-member 400 is removed from the main member 500 as shown in FIG. 15 by only pulling out the second sub-member 400 toward the upper direction. Then, the cylindrical member 230 is exposed toward the upper direction. The cylindrical member 230 is merely placed in the main member 500 so as to surround the second rotating body 610. Specifically, the second sub-member 400 merely holds down an upper portion of the cylindrical member 230 so that the cylindrical member 230 cannot be removed. Thus, the user can easily remove the cylindrical member 230 from the main member 500 by only gripping and pulling up the cylindrical member 230 after the second sub-member 400 is removed.

Figure 16:
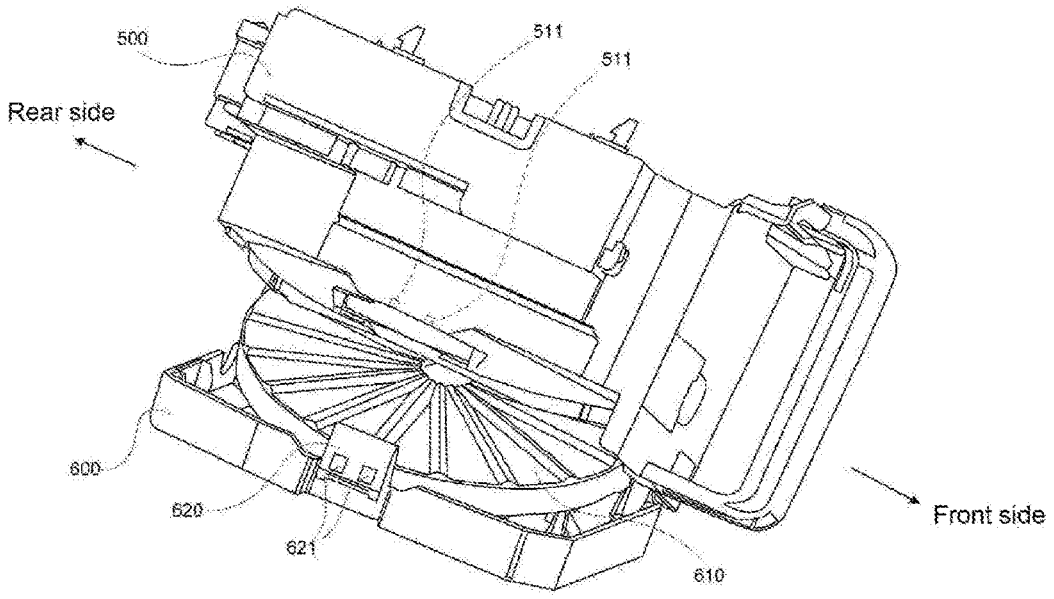
FIG. 16 is a perspective view showing a state that a third sub-member is removed from the medicine dispensing cassette.

After that, the third sub-member 600 is removed from the main member 500 as shown in FIG. 16. As shown in FIG. 16, a U-shaped protruding portion 620 is formed on an upper portion of a left-side surface of the third sub-member 600. A hole 621 is formed in this protruding portion 620. Further, a click 511 is formed on a lower portion of a left-side surface of the main member 500. In a state that the third sub-member 600 is engaged with the main member 500, the hole 621 is engaged with the click 511. When the third sub-member 600 is removed from the main member 500, the user moves a left-side portion of the third sub-member 600 toward the lower direction with pushing the protruding portion 620 toward the inside of the medicine dispensing cassette 200. Since an engagement between the hole 621 and the click 511 is released when the protruding portion 620 is pushed, the user can easily separate the left-side portion of the third sub-member 600 from the main member 500. Although this matter is not shown in the drawings, a right-side portion of the third sub-member 600 is engaged with a right-side portion of the main member 500 through a rod and a slit. Thus, when the left-side portion of the third sub-member 600 is separated from the main member 500, the right-side portion of the third sub-member 600 is pivotally moved around this rod as a pivotal center. Then, when an engagement between the left-side portion of the third sub-member 600 and the left-side portion of the main member 500 is released, the user becomes possible to easily release an engagement due to the rod and the slit. As a result, the engagement between the right-side portion of the third sub-member 600 and the right-side portion of the main member 500 is also released.

As shown in a right-lower portion of FIG. 11, the second rotating body 610 is merely engaged with an upper surface of the third sub-member 600. Thus, the user can easily remove the second rotating body 610 from the third sub-member 600 by only pulling up the second rotating body 610 toward the upper direction.

At the time of assembling the medicine dispensing cassette 200, the second rotating body 610 is first fitted into the third sub-member 600. Next, the third sub-member 600 is attached to the main member 500. Next, as shown in FIG. 15, the cylindrical member 230 is placed in the main member 500 so as to surround the second rotating body 610. Next, as shown in FIG. 14, the second sub-member 400 is attached to the main member 500. Next, as shown in FIG. 13, the first rotating body 220 is provided on the second sub-member 400. Finally, as shown in FIG. 12, the first sub-member 300 is attached to the main member 500.

§ 3.2 Advantage 2 of the Medicine Dispensing Cassette 200

As described above, the user can easily disassemble the medicine dispensing cassette 200 by only operating the operating portions 710 and 710' without using a tool such as a driver and a wrench. Thus, the user can easily disassemble and wash the medicine dispensing cassette 200. With this configuration, it becomes possible to easily clear powder getting into narrow spaces in the medicine dispensing cassette 200.

Further, the medicine dispensing cassette 200 is configured so that the first sub-member 300 and the first rotating body 220 are removed when the first engagement release member 700 and the second engagement release member 700' are moved to the first position F. Furthermore, the second sub-member 400 and the cylindrical member 230 are removed when the first engagement release member 700 and the second engagement release member 700' are moved to the second position S. Since such a configuration can allow the user to associate a sequence of procedures for removing the members with the moving directions of the first engagement release member 700 and the second engagement release member 700', the user can easily keep the sequence of the procedures for removing the members in mind. As a result, the user can easily understand what sequence should be used for attaching the members at the time of assembling the medicine dispensing cassette 200.

§ 3.3 the First Engagement Release Member 700

Figure 17A:
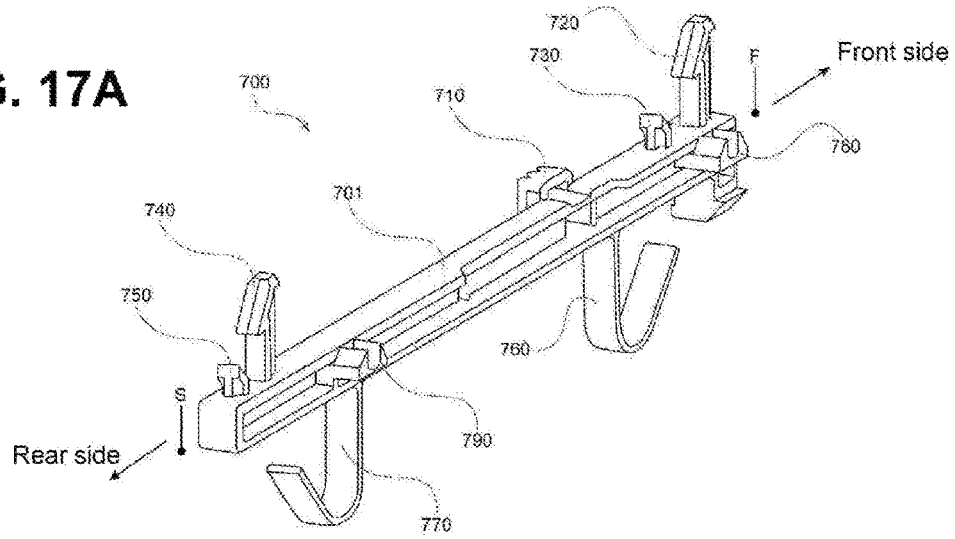
FIG. 17A is a perspective view of a first engagement release member.
Figure 17B:
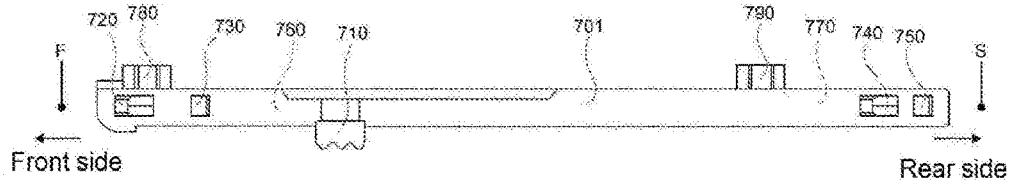
FIG. 17B is a planar view of the first engagement release member.
Figure 18A:
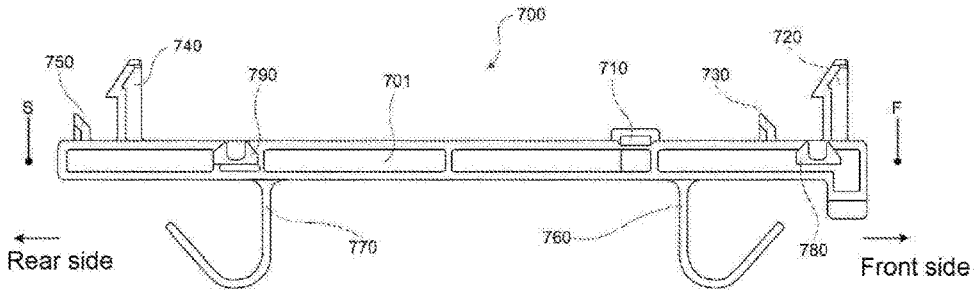
FIG. 18A is a left-side view of the first engagement release member.
Figure 18B:
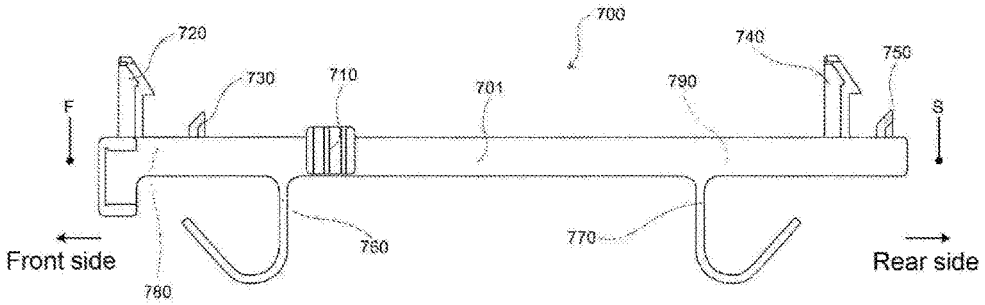
FIG. 18B is a right-side view of the first engagement release member.

As shown in a middle-right portion of FIG. 11, the first engagement release member 700 is provided in the vicinity of a right-side lateral surface of the main member 500. Each of FIGS. 17 and 18 is a view showing a structure of the first engagement release member 700. Specifically, FIG. 17A is a perspective view of the first engagement member 700, FIG. 17B is a planar view of the first engagement member 700, FIG. 18A is a left-side view of the first engagement member 700 and FIG. 18D is a right-side view of the first engagement member 700. As shown in these figures, the first engagement release member 700 has a configuration in which the operating portion 710, a first engaging portion 720, a second engaging portion 730, a third engaging portion 740, a fourth engaging portion 750, a first biasing portion 760, a second biasing portion 770, a first lateral engaging portion 780 and a second lateral engaging portion 790 are formed on a bar-shaped main body 701.

The first engaging portion 720, the second engaging portion 730, the third engaging portion 740 and the fourth engaging portion 750 are provided on an upper surface of the main body 701. More particularly, the first engaging portion 720 is provided on the front side of the main body 701, that is in the vicinity of an end portion of the main body 701 on the side of the first position F. The second engaging portion 730 is provided in the vicinity of the first engaging portion 720 and on the side of the second position S so as to be apart from the first engaging portion 720 by a predetermined distance. The fourth engaging portion 750 is provided on the rear side of the main body 701, that is in the vicinity of an end portion of the main body 701 on the side of the second position S. The third engaging portion 740 is provided in the vicinity of the fourth engaging portion 750 and on the side of the first position F so as to be apart from the fourth engaging portion 750 by a predetermined distance. The first biasing portion 760 and the second biasing portion 770 are provided on a bottom surface of the main body 701. More particularly, the first biasing portion 760 and the second biasing portion 770 are respectively provided at locations being apart from a central portion of the main body 701 by a predetermined distance. The operating portion 710 is provided on a lateral surface on the side facing toward the outside of the medicine dispensing cassette 200 when the first engagement release member 700 is provided in the medicine dispensing cassette 200. The first lateral engaging portion 780 and the second lateral engaging portion 790 are provided on a lateral surface opposite to the operating portion 710. More particularly, the first lateral engaging portion 780 is provided in the vicinity of the end portion of the main body 701 on the side of the first position F so as to protrude toward the lateral side. Further, the second lateral engaging portion 790 is provided at a location being apart from the end portion of the main body 701 on the side of the second position S by a predetermined distance so as to protrude toward the lateral side. The main body 701, the operating portion 710, the first engaging portion 720, the second engaging portion 730, the third engaging portion 740, the fourth engaging portion 750, the first biasing portion 760, the second biasing portion 770, the first lateral engaging portion 780 and the second lateral engaging portion 790 are integrally formed from one material. With this configuration, it becomes easier to produce the first engagement release member 700 and assemble the medicine dispensing cassette 200.

Figure 21:
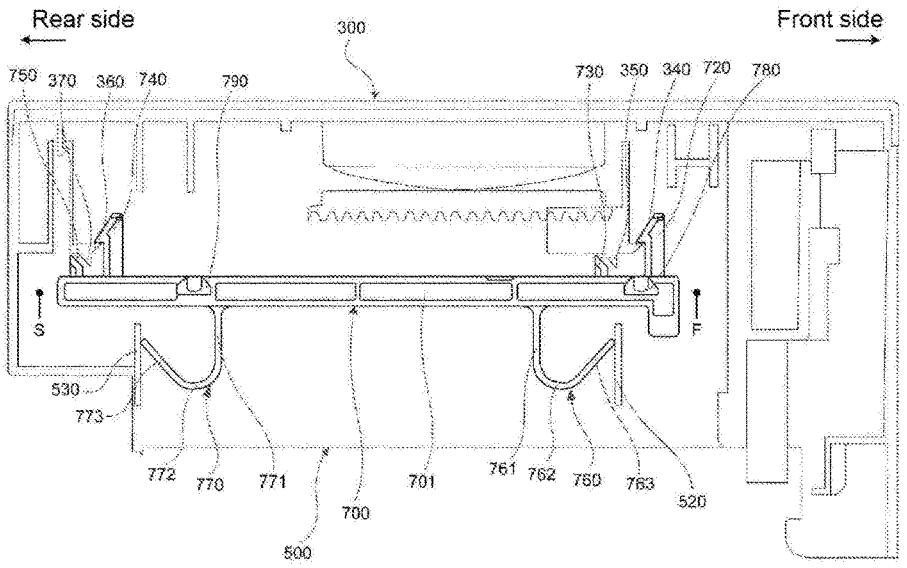
FIG. 21 is a simplified cross-sectional side view in the vicinity of the first engagement release member in the medicine dispensing cassette. In this regard, this figure is a view of the first engagement release member seen from a center side toward a right side of the medicine dispensing cassette.

FIG. 21 shows a state that the first engagement release member 700 is provided in the main member 500. In this regard, this figure is a view of the first engagement release member 700 seen from the inner-side toward the right-side of the main member 500. As shown in this figure, each of the first biasing member 760 and the second biasing member 770 is constituted of a plate-like material having a substantially V or U-shape, that is a leaf spring. Thus, the first biasing portion 760 has a base end portion 761, a bent portion 762 and a tip end portion 763. In the same manner, the second biasing member 770 has a base end portion 771, a bent portion 772 and a tip end portion 773. The base end portions 761 and 771 straight extend from the bottom surface of the main body 701 toward the lower direction. Further, the first biasing portion 760 and the second biasing portion 770 are sharply bent at the bent portions 762 and 772. Thus, the tip end portions 763 and 773 straight extend toward the diagonal upper direction. Further, a tip end of the tip end portion 763 makes contact with a front-side inner wall 520 of the main member 500 and presses the front-side inner wall 520. In the same manner, a tip end of the tip end portion 773 makes contact with a rear-side inner wall 530 of the main member 500 and presses the rear-side inner wall 530. The first biasing portion 760 and the second biasing portion 770 have elastic force, which is caused by the bent portions 762 and 772, for enlarging a space between the base end portion 761 and the tip end portion 763 and a space between the base end portion 771 and the tip end portion 773, that is elastic force for enlarging angles formed by the both portions. Thus, the first biasing member 760 biases the first engagement release member 700 in a direction for allowing the first engagement release member 700 to be moved toward the second position S. Further, the second biasing portion 770 biases the first engagement release member 700 in a direction for allowing the first engagement release member 700 to be moved toward the first position F. Thus, even if the user moves the first engagement release member 700 in the direction toward the first position F or in the direction toward the second position S, the first biasing portion 760 and the second biasing portion 770 bias the first engagement member 700 so that the first engagement member 700 returns to a position in the middle of the first position F and the second position S.

§ 3.4 the Second Engagement Release Member 700'

As shown in a middle-right portion of FIG. 11, the second engagement release member 700' is provided in the vicinity of a left-side lateral surface of the main member 500. A big difference between the first engagement release member 700 and the second engagement release member 700' is a length thereof. By making the lengths of the first engagement release member 700 and the second engagement release member 700' different from each other as shown in this embodiment, it is possible to locate engaging portions of the first engagement release member 700 and the second engagement release member 700' with respect to the other members in the vicinity of the mechanically important members in the main member 500. As a result, protection for the important inner members by the first sub-member 300 and the second sub-member 400 can be improved. Further, in the medicine dispensing cassette 200, a distance D from a front-side lateral surface of the main member 500 to the operating portion 710 of the first engagement release member 700 is substantially equal to a distance D' from the front-side lateral surface of the main member 500 to the operating portion 710' of the second engagement release member 700'. With this configuration, when the user simultaneously operates both of the operating portions 710 and 710' by using his/her right-hand and left-hand, the user can easily simultaneously move the operating portions 710 and 710' in the same direction.

Figure 19A:
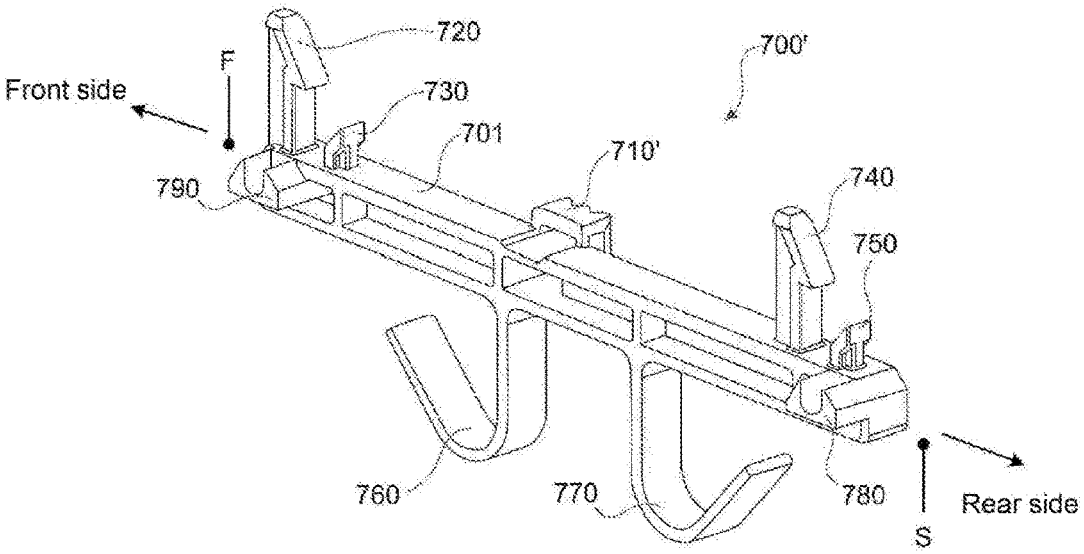
FIG. 19A is a perspective view of a second engagement release member.
Figure 19B:
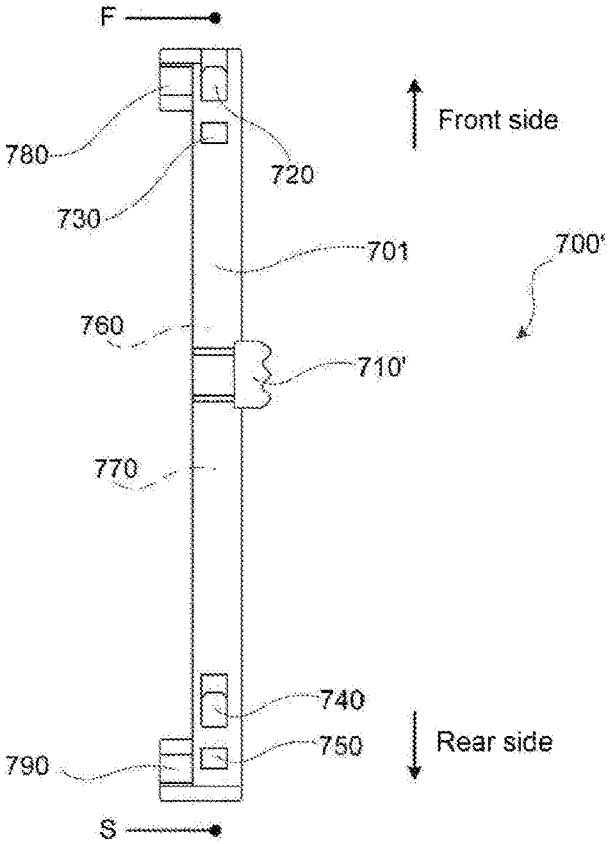
FIG. 19B is a planar view of the second engagement release member.
Figure 20A:
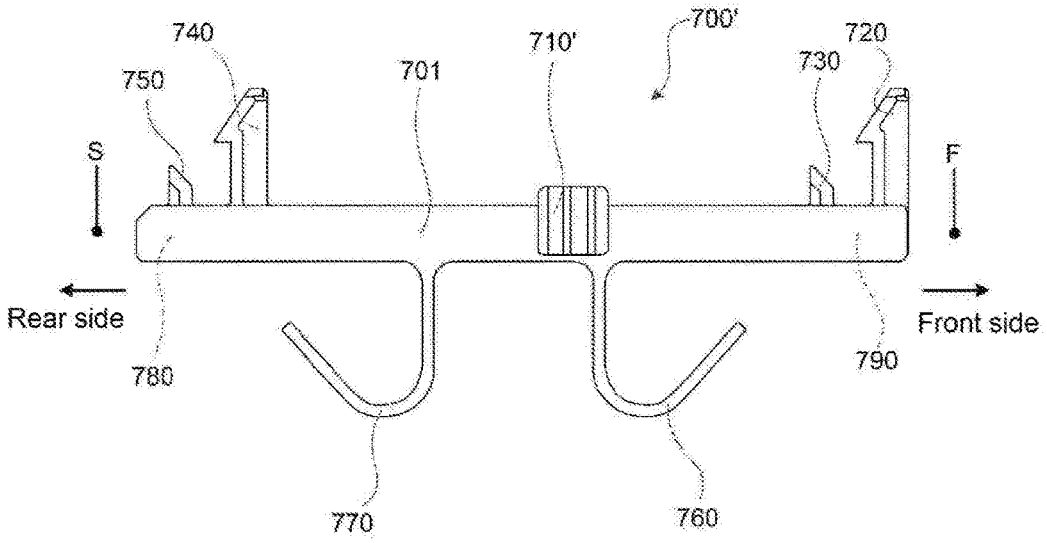
FIG. 20A is a right-side view of the second engagement release member.
Figure 20B:
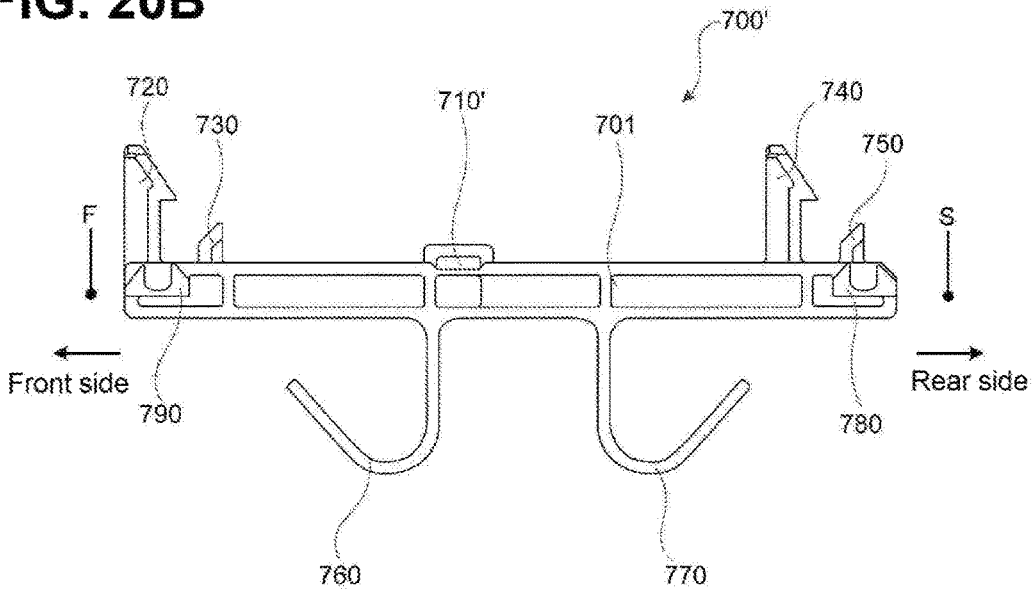
FIG. 20B is a left-side view of the second engagement release member.

Each of FIGS. 19 and 20 is a view showing a structure of the second engagement member 700'. Specifically, FIG. 19A is a perspective view of the second engagement release member 700', FIG. 19B is a planar view of the second engagement release member 700', FIG. 20A is a left-side view of the second engagement release member 700' and FIG. 20B is a right-side view of the second engagement release member 700'. As shown in these figures, the second engagement release member 700' also has a configuration in which the operating portion 710', a first engaging portion 720, a second engaging portion 730, a third engaging portion 740, a fourth engaging portion 750, a first biasing portion 760, a second biasing portion 770, a first lateral engaging portion 780 and a second lateral engaging portion 790 are formed on a bar-shaped main body 701 as is the case with the first engagement member 700. Configurations and functions of these portions are basically same as those of the first engagement release member 700 and thus description for these portions is omitted. Further, although a mechanism for the engagement/engagement release of the first engagement release member 700 and the first sub-member 300 and a mechanism for the engagement/engagement release of the first engagement release member 700 and the second sub-member 400 will be explained in the following description, it is noted that these mechanisms for the engagement/engagement release are same as the mechanisms for the engagement/engagement release of the second engagement release member 700' and the first sub-member 300 and the engagement/engagement release of the second engagement release member 700' and the second sub-member 400.

§ 3.5 the Engagement/Engagement Release of the First Engagement Release Member 700 and the First Sub-Member 300

As shown in FIG. 21, the first engaging portion 340 and the second engaging portion 350 are formed on a front-side bottom portion of the first sub-member 300. Further, the third engagement portion 360 and the fourth engaging portion 370 are formed on a rear-side bottom portion of the first sub-member 300. When the first sub-member 300 is engaged with the main member 500, the first engaging portion 340 of the first sub-member 300 is engaged with the first engaging portion 720 of the first engagement release member 700 and the third engaging portion 360 of the first sub-member 300 is engaged with the third engaging portion 740 of the first engagement release member 700.

Figure 22A:
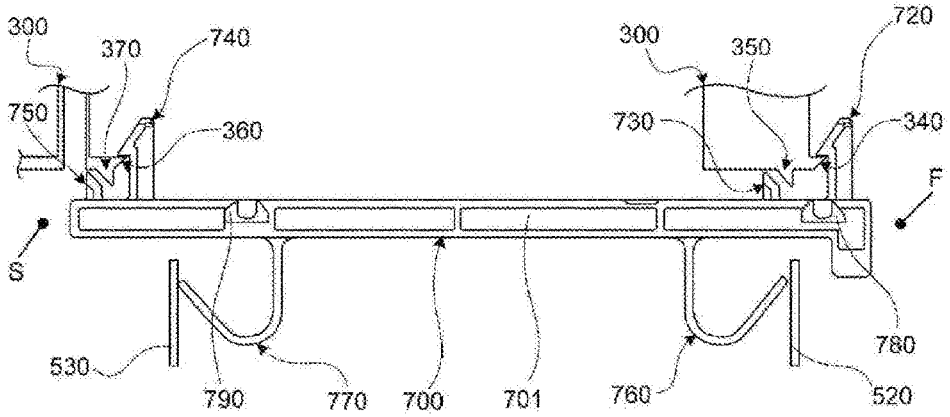
FIGS. 22A through 22C are schematic view for explaining a mechanism allowing the first engagement release member to release an engagement between a main member and the first sub-member.
Figure 22B:
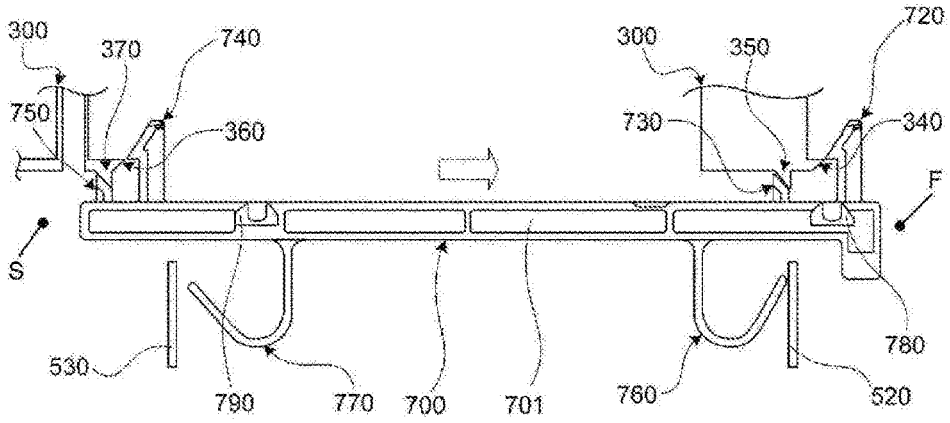
Figure 22C:
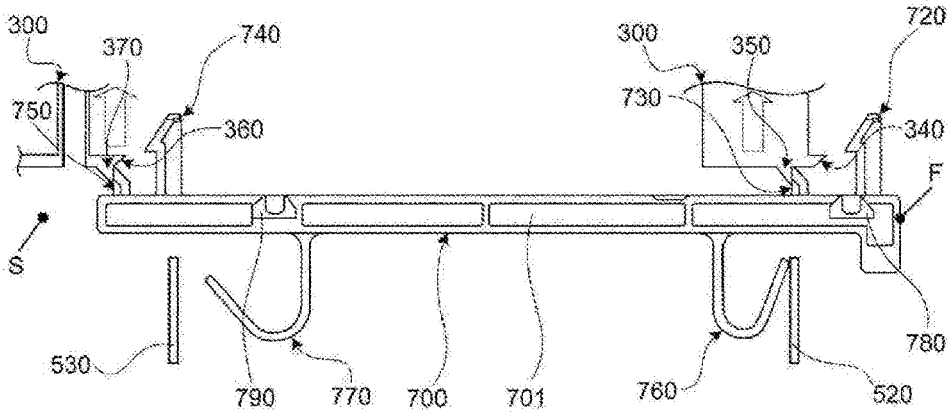
Figure 23:
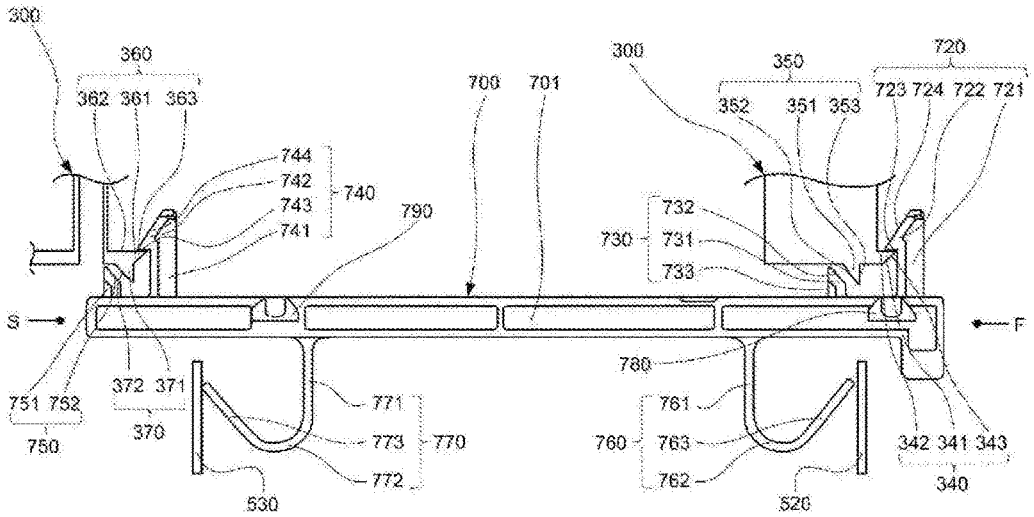
FIG. 23 is a view showing FIG. 22A in more detail.
Figure 24:
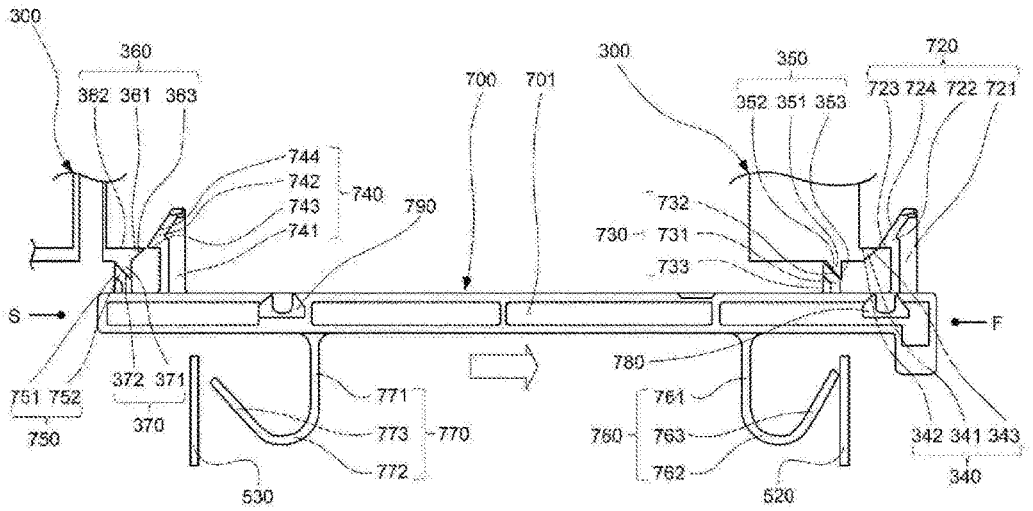
FIG. 24 is a view showing FIG. 22B in more detail.
Figure 25:
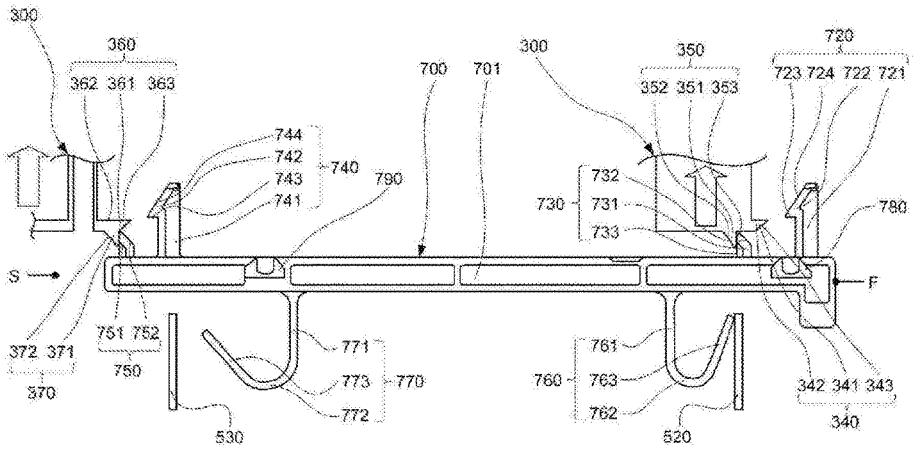
FIG. 25 is a view showing FIG. 22C in more detail.

Each of FIGS. 22 to 25 is a schematic view for explaining a mechanism for allowing the first engagement release member 700 to engage the first sub-member 300 or release the engagement of the first sub-member 300. More particularly, FIGS. 22A through 22C are schematic view for explaining an outline of the mechanism for allowing the first engagement release member 700 to engage the first sub-member 300 or release the engagement of the first sub-member 300. FIG. 23 is a view for explaining FIG. 22A in more detail. FIG. 24 is a view for explaining FIG. 22B in more detail. FIG. 25 is a view for explaining FIG. 22C in more detail.

FIG. 22A shows a state that the first sub-member 300 is engaged with the main member 500. Focusing on a right-side of the FIG. 22A, the first engaging portion 340 is engaged with the first engaging portion 720 in this state. As shown in FIG. 23, the first engaging portion 720 includes a first vertically protruding portion 721 and a horizontally protruding portion 722. The first vertically protruding portion 721 protrudes from the main body 701 toward the upper direction. The horizontally protruding portion 722 protrudes from the first vertically protruding portion 721 in a direction toward the second position S. The first engaging portion 340 includes a first protruding portion 341. This first protruding portion 341 protrudes in a direction toward the first position F. Thus, a tip end portion of the first protruding portion 341 is directed toward a lateral surface of the first vertically protruding portion 721 on the side of the second position S. Further, an upper surface 343 of the first protruding portion 341 faces a bottom surface 723 of the horizontally protruding portion 722. In other words, the upper surface 342 of the first protruding portion 341 is engaged with the bottom surface 723 of the horizontally protruding portion 722. Thus, even if the user tries to pull up the first sub-member 300 toward the upper direction in this state, the bottom surface 723 of the horizontally protruding portion 722 blocks the movement of the first protruding portion 341 toward the upper direction. As a result, the first sub-member 300 cannot be removed from the main member 500.

FIG. 22B shows a state that the first engagement release member 700 is slightly moved in the direction toward the first position F. In this state, the first engaging portion 340 and the first engaging portion 720 are being separated from each other. Namely, the engagement between the first engaging portion 340 and the first engaging portion 720 is being released. Alternatively, the second engaging portion 350 and the second engaging portion 730 make contact with each other. As shown in FIG. 24, the second engaging portion 730 includes a second vertically protruding portion 731 protruding from the main body 701 toward the upper direction. The second engaging portion 350 includes a second protruding portion 351 protruding toward the lower direction. The second vertically protruding portion 731 has an inclined surface 732 and a lateral surface 733. The inclined surface 732 faces a direction between the direction toward the first position F and the upper direction. The lateral surface 733 faces the direction toward the second position S. Further, the second vertically protruding portion 351 has an inclined surface 352 and a lateral surface 353. The inclined surface 352 faces a direction between the direction toward the second position S and the lower direction. The lateral surface 353 faces the direction toward the first position F.

As shown in FIG. 24, when the first engagement release member 700 is moved in the direction toward the first position F against the biasing force of the first biasing portion 760, the second vertically protruding portion 731 abuts against the second vertically protruding portion 351 to push the second vertically protruding portion 351 toward the upper direction. More particularly, due to the movement of the second vertically protruding portion 731, the inclined surface 352 of the second vertically protruding portion 351 slides on the inclined surface 732 of the second vertically protruding portion 731 toward the upper direction. As a result, the first sub-member 300 is moved toward the upper direction along with the movement of the first engagement release member 700. In this regard, in a case that the use takes his/her hand off the operating portion 710 in the state shown in FIG. 24, the first engagement release member 700 is returned to the position shown in FIG. 23 by the biasing force of the first biasing member 760.

When the first engagement release member 700 is moved to the first position F, the relationship between the first engagement release member 700 and the first sub-member 300 takes a state as shown in FIG. 22C. In this state, the second engaging portion 350 is engaged with the second engaging portion 730. As shown in FIG. 25, when the second vertically protruding portion 731 is moved to an end of the second vertically protruding portion 351, that is the first position F, the first sub-member 300 falls down due to the gravity. As a result, the second engaging portion 350 is engaged with the second engaging portion 730. More particularly, the lateral surface 353 of the second vertically protruding portion 351 is engaged with the lateral surface 733 of the second vertically protruding portion 731. In this state, the movement of the first engagement release member 700 in the direction toward the second position S is blocked by the second vertically protruding portion 351. Thus, even if the use takes his/her hand off the operating portion 710, the state that the second vertically protruding portion 351 is engaged with the second vertically protruding portion 731 is kept. In this state, the first engaging portion 720 is separated from the first engaging portion 340. Namely, the horizontally protruding portion 722 does not block the movement of the first protruding portion 341 toward the upper direction. Thus, when the user pulls the first sub-member 300 toward the upper direction in the state shown in FIG. 22C, the first sub-member 300 is removed from the main member 500.

As described above, in the medicine dispensing cassette 200, when the first engagement release member 700 is moved to the first position F, the first sub-member 300 is moved toward the lower direction after the first sub-member 300 is once moved toward the upper direction. During the disassembling operation for the medicine dispensing cassette 200, the user can check this movement with his/her own eyes. Thus, the user can easily know that the first sub-member 300 becomes in a removable state during the operation for the operating portion 710.

According to the medicine dispensing cassette 200, it is easy to attach the removed first sub-member 300 to the main member 500. As shown in FIG. 23, an inclined surface 724 facing a direction between the direction toward the first position S and the upper direction is formed on the horizontally protruding portion 722. Further, an inclined surface 343 facing a direction between the direction toward the first position F and the lower direction is formed on the first protruding portion 341. As described above, the first engagement release member 700 is positioned at the location in the substantially middle of the first position F and the second position S due to the biasing force of the first biasing portion 760 and the second biasing portion 770 in the state that the operating portion 710 is not operated. When the user moves the first sub-member 300 from the substantially vertical upper direction toward the substantially vertical lower direction of the main member 500 in this state, the inclined surface 343 of the first protruding portion 341 abuts against the inclined surface 724 of the horizontally protruding portion 722. As a result, the inclined surface 343 pushes the inclined surface 724 in the direction toward the first position F and the first engagement release member 700 is moved in the direction toward the first position F. Then, when the first protruding portion 341 reaches under the horizontally protruding portion 722, the first engagement release member 700 is moved in the direction toward the second position S by the biasing force of the first biasing portion 760. As a result, the bottom surface 723 of the horizontally protruding portion 722 is engaged with the upper surface 342 of the first protruding portion 341 and thus the first sub-member 300 is engaged with the main member 500.

The operations described above also occur in the left-side of FIGS. 22A through 22C. Namely, a mechanism for allowing the first engagement release member 700 to engage the first sub-member 300 or release the engagement of the first sub-member 300 on the left-side of FIGS. 22A through 22C is the same as the described one. Specifically, in the first engagement release member 700, the third engaging portion 740 provides the same function as the first engaging portion 720 and the fourth engaging portion 750 provides the same function as the second engaging portion 730. Further, in the first sub-member 300, the third engaging portion 360 provides the same function as the first engaging portion 340 and the fourth engaging portion 370 provides the same function as the second engaging portion 350.

Thus, as shown in FIG. 23, the third engaging portion 740 has the same shape as the first engaging portion 720 and the third engaging portion 740 has a third vertically protruding portion 741 and a horizontally protruding portion 742 as is the case with the first engaging portion 720. Further, the horizontally protruding portion 742 included in the third engaging portion 740 is directed to the same direction as the horizontally protruding portion 722 included in the first engaging portion 720. More specifically, the horizontally protruding portion 742 has an inclined surface 744 similar to the inclined surface 724 included in the horizontally protruding portion 722. This inclined surface faces the same directions as the inclined surface 724.

Further, the fourth engaging portion 750 has the same shape as the second engaging portion 730 and has a fourth vertically protruding portion 751 similar to the second vertically protruding portion 731. Further, the fourth vertically protruding portion 751 is directed toward the same direction as the second vertically protruding portion 731. More specifically, the fourth vertically protruding portion 751 has an inclined surface 752 similar to the inclined surface 732 included in the second vertically protruding portion 731. This inclined surface 752 faces the same direction as the inclined surface 732.

Further, the third engaging portion 360 has the same shape as the first engaging portion 340 and has a third protruding portion 361 similar to the first protruding portion 341. Furthermore, the third protruding portion 361 is directed toward the same direction as the first protruding portion 341. More specifically, the third protruding portion 361 has an inclined surface 360 similar to the inclined surface 343 of the first protruding portion 341. This inclined portion 363 faces the same direction as the inclined surface 343.

In the same manner, the fourth engaging portion 370 has the same shape as the second engaging portion 350 and has a fourth protruding portion 371 similar to the second protruding portion 351. Further, the fourth protruding portion 371 is directed toward the same direction as the second protruding portion 351. More specifically, the fourth protruding portion 371 has an inclined surface 372 similar to the inclined surface 352 included in the second protruding portion 351. This inclined surface 373 faces the same direction as the inclined surface 352.

As shown in FIG. 23, in a state that the first sub-member 300 is engaged with the first engagement release member 700, the upper surface 362 of the third protruding portion 361 is engaged with a bottom surface 743 of the horizontally protruding portion 742. Thus, even if the user tries to pull up the first sub-member 300 in this state, the first sub-member 300 is not removed from the main member 500.

As shown in FIG. 24, when the first engagement release member 700 is moved in the direction toward the first position F, the fourth vertically protruding portion 751 abuts against the fourth vertically protruding portion 371 to push the fourth vertically protruding portion 371 toward the upper direction. As a result, the first sub-member 300 is moved toward the upper direction along with the movement of the first engagement release member 700.

As shown in FIG. 25, when the first engagement release member 700 is further moved to the first position F, the first sub-member 300 falls down due to the gravity. As a result, the fourth engaging portion 370 is engaged with the fourth engaging portion 750. When the user pulls up the first sub-member 300 in this state, the first sub-member 300 is removed from the main member 500.

§ 3.6 the Engagement/the Release of the Engagement Between the First Engagement Release Member 700 and the Second Sub-Member 700

Figure 26A:
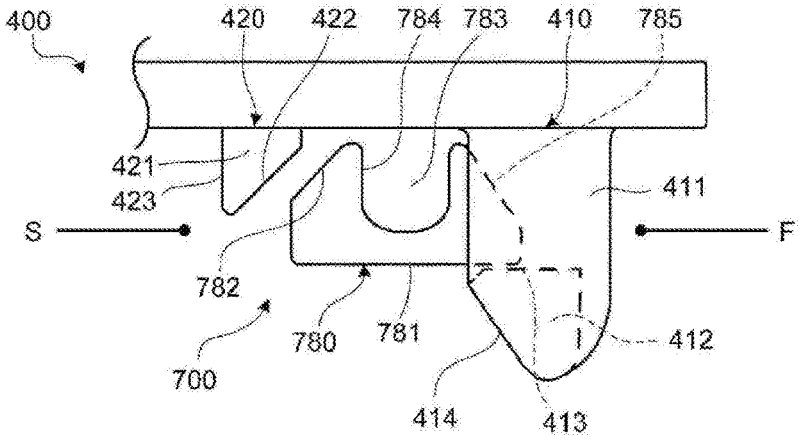
FIGS. 26A through 26C are schematic view for explaining a mechanism allowing the first engaging member to release an engagement between the main body and the second sub-member.
Figure 26B:
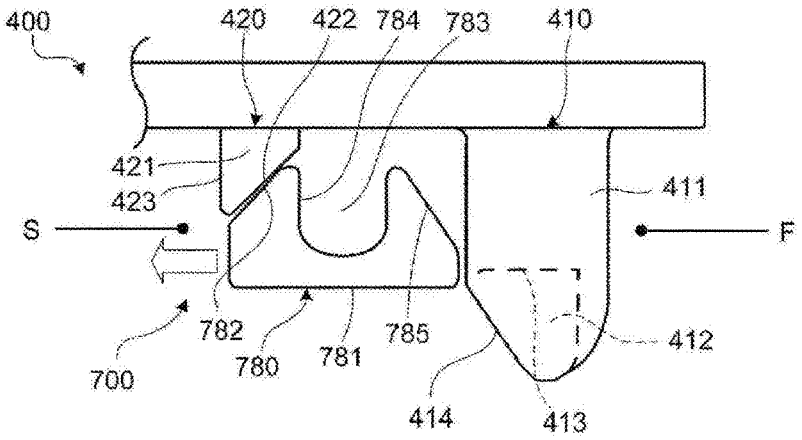
Figure 26C:
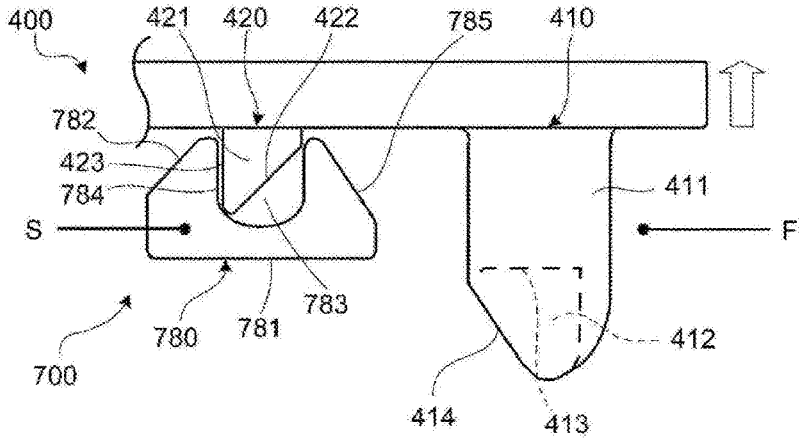

FIGS. 26A through 26C are schematic view explaining a mechanism for allowing the first engagement release member 700 to engage the second sub-member 400 or release the engagement of the second sub-member 400. As shown in this figure, the first engaging portion 410 and the second engagement portion 420 are formed on a front-side end portion of the second sub-member 400. FIG. 26A shows a state that the second sub-member 400 is engaged with the main member 500. In this state, the first engaging portion 410 of the second sub-member 400 is engaged with the first lateral engaging portion 780.

The first lateral engaging portion 780 includes a bottom surface 781. The first engaging portion 410 includes a vertically protruding portion 411 and a horizontally protruding portion 412. The first vertically protruding portion 411 protrudes from the second sub-member 400 toward the lower direction. Further, the first vertically protruding portion 411 is positioned on the lateral side of the first lateral engaging portion 780. Thus, assuming that the first lateral engaging portion 780 is positioned on the plane of paper of FIGS. 26A through 26C, the first vertically protruding portion 411 is positioned on the upper side of the plane of paper. In other words, the first vertically protruding portion 411 is not positioned on a moving path of the first lateral engaging portion 780 and the first vertically protruding portion 411 is positioned so as to be adjacent to a lateral portion of the moving path of the first lateral engagement portion 780. The horizontally protruding portion 412 protrudes from a tip end portion of the first vertically protruding portion 411 toward the horizontal direction. More particularly, the horizontally protruding portion 412 horizontally protrudes from a lower end portion of the first vertically protruding portion 411 toward the lower side of the first lateral engaging portion 780. Thus, assuming that the first vertically protruding portion 411 is positioned on the upper side of the plane of paper of FIGS. 26A through 26C, the horizontally protruding portion 412 protrudes toward the plane of paper. In other words, the horizontally protruding portion 412 is positioned so as to be adjacent to a lower portion of the first lateral engaging portion 780. Thus, an upper surface 413 of the horizontally protruding portion 412 faces the bottom surface 781 of the first lateral engaging portion 780. In other word, the upper surface 413 of the horizontally protruding portion 412 is engaged with the bottom surface 781 of the first lateral engaging portion 780. Thus, even if the user tries to pull up the second sub-member 400 in this state, the bottom surface 781 of the first lateral engaging portion 780 blocks the movement of the horizontally protruding portion 412 toward the upper direction. As a result, the second sub-member 400 is not removed from the main member 500.

FIG. 26B shows a state that the first engagement release member 700 is slightly moved in the direction toward the second position S. As shown in this figure, the first lateral engaging portion 780 includes an inclined surface 782 and an opening portion 783. The inclined surface 782 faces a direction between the direction toward the second position S and the upper direction. The opening portion 783 is opened toward the upper direction and internally has an inner surface 784 facing the direction toward the first position F. The second engaging portion 420 includes a second vertically protruding portion 421 protruding from the second sub-member 400 toward the lower direction. The second vertically protruding portion 421 has an inclined surface 422 and a lateral surface 423. The inclined surface 422 faces a direction between the direction toward the first position F and the lower direction. The lateral surface 423 faces the direction toward the second position S.

As shown in FIG. 26B, when the first engagement release member 700 is moved in the direction toward the second position S against the biasing force of the second biasing member 770 (not shown in the drawings), the first lateral engaging portion 780 abuts against the second vertically protruding portion 421 to push the second vertically protruding portion 421 toward the upper direction. More particularly, due to the movement of the first lateral protruding portion 780, the inclined surface 422 of the second vertically engaging portion 421 slides on the inclined surface 782 of the first lateral engaging portion 780 toward the upper direction. As a result, the second sub-member 400 is moved toward the upper direction along with the movement of the first engagement release member 700. In this regard, in a case that the user takes his/her hand off the operating portion 710, the first engagement release member 700 is returned to the position shown in FIG. 26A by the biasing force of the second biasing portion 770.

When the first engagement release portion 700 is further moved to the second position S, the relationship between the first engagement portion 700 and the second sub-member 700 takes a state as shown in FIG. 26C. As shown in this figure, when the opening portion 783 is moved to just below the second vertically protruding portion 421, that is the second position S, the second sub-member 400 falls down due to the gravity. As a result, the second engaging portion 420 is engaged with the first lateral engaging portion 780. More particularly, the lateral surface 423 of the second vertically protruding portion 421 is engaged with the inner surface 784 of the opening portion 783. In this state, the movement of the first engagement release member 700 in the direction toward the first position F is blocked by the second vertically protruding portion 421. Thus, even if the user takes his/her hand off the operating portion 710, the state that the second vertically protruding portion 421 is engaged with the opening portion 783 is kept. In this state, the first lateral engaging portion 780 is separated from the first engaging portion 410. Namely, the bottom surface 781 of the first lateral engaging portion 780 does not block the movement of the horizontally protruding portion 412 toward the upper direction. Thus, when the user pulls up the second sub-member 400 in the state shown in FIG. 26C, the second sub-member 400 is removed from the main member 500.

As described above, in the medicine dispensing cassette 200, when the first engagement release member 700 is moved to the second position S, the second sub-member 400 is moved toward the lower direction after the second sub-member 400 is once moved toward the upper direction. During the disassembling operation for the medicine dispensing cassette 200, the user can check this movement with his/her own eyes. Thus, the user can easily know that the second sub-member 400 becomes in the removable state during the operation of the operating portion 710. In addition, the movement of the second sub-member 400 in the vertical direction during the disassembling operation for the second sub-member 400 is the same as the movement of the first sub-member 300 in the vertical direction during the disassembling operation for the first sub-member 300. Thus, the user can rapidly understand the timing of being able to remove the members after what movement is performed during the disassembling operation for the medicine dispensing cassette 200.

In this regard, in the medicine dispensing cassette 200, the second sub-member 400 cannot be removed in a state that the first sub-member 300 is not removed. As shown in FIGS. 21 and 23, the first protruding portion 341 blocks the movement of the first vertically protruding portion 721 toward the second position S in the state that the first engaging portion 340 is engaged with the first engaging portion 720. In addition, the first sub-member 300 blocks the movement of the second sub-member 400 toward the upper direction in the state that the first sub-member 300 is engaged with the main member 500. Thus, the first engagement release member 700 cannot also push up the second sub-member 400. As a result, the first engagement release member 700 cannot move to the second position S in the state that the first engagement release member 700 is engaged with the first sub-member 300. Namely, the engagement between the main member 500 and the second sub-member 400 cannot be released in the state that the first sub-member 300 is engaged with the main member 500. With this configuration, it is possible to prevent the position of the second sub-member 400 in the medicine dispensing cassette 200 from being carelessly shifted and prevent the engagement from being released and thus the second sub-member 400 from being in an unstable state. As shown in FIG. 10, the second sub-member 400 cannot be seen from the outside normally in the state that the medicine dispensing cassette 200 has been assembled. Thus, if the user can mistakenly move the first engagement release member 700 to the second position S in the state that the first sub-member 300 is attached to the main member 500, the user cannot find out an event that the second sub-member 400 is removed from the main member 500. Of course, it is undesired that the medicine dispensing cassette 200 is set in the medicine dispensing apparatus 100 in the state that the second sub-member 400 is removed from the main member 500. By configuring the medicine dispensing cassette 200 so that the engagement between the second sub-member 400 and the main member 500 cannot be released in the state that the first sub-member 300 is engaged with the main member 500, it is possible to prevent such an undesired situation.

In the medicine dispensing cassette 200, it is also easy to attach the removed second sub-member 400 to the main member 500. As shown in FIG. 26A, an inclined surface 785 facing a direction between the direction toward the first position S and the upper direction is formed on the first lateral engaging portion 780. Further, an inclined surface 414 facing a direction between the direction toward the second position S and the lower direction is formed on the horizontally protruding portion 412. As described above, the first engagement release member 700 is positioned at the substantially middle of the first position F and the second position S in the state that the operating portion 710 is not operated due to the biasing force of the first biasing portion 760 and the second biasing portion 770 (see FIG. 21). When the user moves the second sub-member 400 from the substantially vertical upper direction toward the substantially vertical lower direction of the main member 500 in this state, the inclined surface 414 of the horizontally protruding portion 412 abuts against the inclined surface 785 of the first lateral engaging portion 780. As a result, the inclined surface 414 pushes the inclined surface 785 in the direction toward the second position S and thus the first engagement release member 700 is moved in the direction toward the second position S. Then, when the horizontally protruding portion 412 reaches under the bottom surface 781, the first engagement release member 700 is moved in the direction toward the first position F by the biasing force of the second biasing portion 770. As a result, the bottom surface 781 is engaged with the upper surface 413 and the second sub-member 400 is engaged with the main member 500.

As shown in FIGS. 17 and 18, the lateral engaging portion 790 has the same shape as the first lateral engaging portion 780. Thus, the second lateral engaging portion 790 also uses the same mechanism as that of the first lateral engaging portion 780 to engage the second sub-member 400 and release the engagement of the second sub-member.

DESCRIPTION OF REFERENCE SIGNS

100 . . . Medicine dispensing apparatus
110 . . . Vial bottle supplying device
120 . . . Labeling device
130 . . . Vial bottle carrying device
140 . . . Discharging port
150 . . . Cassette placing portion
160 . . . Touch panel display
170 . . . Optical scanner
180 . . . Medicine supplying portion
181 . . . RF tag reading device
182 . . . Lock release device
190 . . . Control device
200 . . . Medicine dispensing cassette 200
210 . . . Main body
211 . . . RF tag
212 . . . Hole
213 . . . Right-side inner wall
220 . . . First rotating body
230 . . . Cylindrical member
300 . . . First sub-member
310 . . . Cover
311 . . . Hinge
320 . . . First engaging portion
321 . . . First protruding portion
322 . . . First slit
330 . . . Second engaging portion
331 . . . Second protruding portion
332 . . . Second slit
340 . . . First engaging portion
341 . . . First protruding portion
342 . . . Upper surface
343 . . . Inclined surface
350 . . . Second engaging portion
351 . . . Second protruding portion
352 . . . Inclined surface
353 . . . Lateral surface
360 . . . Third engaging portion
361 . . . Third protruding portion
362 . . . Upper surface
363 . . . Lateral surface
370 . . . Fourth engaging portion
371 . . . Fourth protruding portion
372 . . . Inclined surface
400 . . . Second sub-member
410 . . . First engaging portion
411 . . . First vertically protruding portion
412 . . . Horizontally protruding portion
413 . . . Upper surface
414 . . . Inclined surface
420 . . . Second engaging portion
421 . . . Second vertically protruding portion
422 . . . Inclined surface
423 . . . Lateral surface
500 . . . Main member
511 . . . Click
520 . . . Front-side inner wall
530 . . . Rear-side inner wall
600 . . . Third sub-member
610 . . . Second rotating body
620 . . . Protruding portion
621 . . . Hole
700 . . . First engagement release member
700' Second engagement release member
701 . . . Main body
710 . . . Operating portion
710' Operating portion
720 . . . First engaging portion
721 . . . First vertically protruding portion
722 . . . Horizontally protruding portion
723 . . . Bottom surface
724 . . . Inclined surface
730 . . . Second engaging portion
731 . . . Second vertically protruding portion
732 . . . Inclined surface
733 . . . Lateral surface
740 . . . Third engaging portion
741 . . . First vertically protruding portion
742 . . . Horizontally protruding portion
743 . . . Bottom surface
744 . . . Inclined surface
750 . . . Fourth engaging portion
751 . . . Fourth vertically protruding portion
752 . . . Inclined surface
760 . . . First biasing portion
761 . . . Base end portion
762 . . . Bent portion
763 . . . Tip end portion
770 . . . Second biasing portion
771 . . . Base end portion
772 . . . Bent portion
773 . . . Tip end portion
780 . . . First lateral engaging portion
781 . . . Bottom surface
782 . . . Inclined surface
783 . . . Opening portion
784 . . . Inner surface
785 . . . Inclined surface
790 . . . Second lateral engaging portion
800 . . . Lock mechanism
810 . . . Operating lever
811 . . . Fulcrum point portion
812 . . . Force point portion
813 . . . Working point portion
820 . . . Actuating force transmission lever
830 . . . Shaft
840 . . . Biasing member
841 . . . Base end portion
842 . . . Bent portion
843 . . . Tip end portion
850 . . . First engaging member
810 . . . First click
860 . . . Second engaging member
861 . . . Second click

What is claimed is:

1. A medicine dispensing cassette for dispensing medicines contained therein, the medicine dispensing cassette comprising:

a main body including a main member;

a first sub-member engaged with the main member;

a second sub-member engaged with the main member; and an engagement release member provided on the main member, wherein the engagement release member is engaged with both of the first sub-member and the second sub-member, wherein when the engagement release member is moved to a first position, an engagement between the engagement release member and the first sub-member is released, and thereby the first sub-member becomes possible to be removed from the main member, and wherein when the engagement release member is moved to a second position, an engagement between the engagement release member and the second sub-member is released, and thereby the second sub-member becomes possible to be removed from the main member.

2. The medicine dispensing cassette as recited in claim 1, wherein the first sub-member is engaged with an upper portion of the main member, and wherein the second sub-member is provided between the main member and the first sub-member.

3. The medicine dispensing cassette as recited in claim 1 further comprising a first rotating body rotating in the main body, wherein when the first sub-member is separated from the main body, the first rotating body becomes removable from the main body.

4. The medicine dispensing cassette as recited in claim 1, wherein the engagement release member is provided on a lateral surface of the main member, and wherein the engagement release member can be moved in a front-rear direction of the medicine dispensing cassette.

5. The medicine dispensing cassette as recited in claim 1, wherein the engagement release member cannot be moved to the second position in a state that the engagement release member is engaged with the first sub-member.

6. The medicine dispensing cassette as recited in claim 5, wherein the first sub-member blocks movement of the engagement release member toward the second position in the state that the engagement release member is engaged with the first sub-member, and thereby the engagement release member cannot be moved to the second position.

7. The medicine dispensing cassette as recited in claim 1, wherein the engagement release member has a first engagement release member and a second engagement release member, wherein the first engagement release member is provided on one lateral surface of the main member, wherein the second engagement release member is provided on another lateral surface of the main member, and wherein a length of the first engagement release member is different from a length of the second engagement release member.

8. The medicine dispensing cassette as recited in claim 7, wherein the first engagement release member has an operating portion exposed on the outside of the main member, wherein the second engagement release member also has an operating portion exposed on the outside of the main body, and wherein a distance from a front-side lateral surface of the main body to the operating portion of the first engagement release member is substantially equal to a distance from the front-side lateral surface of the main member to the operating portion of the second engagement release member.

9. The medicine dispensing cassette as recited in claim 1, wherein the first sub-member includes a first sub-member first engaging portion and a first sub-member second engaging portion, wherein the engagement release member includes:

an engagement release member main body, an engagement release member first engaging portion provided on the engagement release member main body, and an engagement release member second engaging portion provided on the engagement release member main body, wherein when the first sub-member is engaged with the main member, the first sub-member first engaging portion is engaged with the engagement release member first engaging portion, and wherein when the engagement between the first sub-member and the main member is released, the first sub-member second engaging portion makes contact with the engagement release member second engaging portion.

10. The medicine dispensing cassette as recited in claim 9, wherein the first sub-member first engaging portion includes a first sub-member first protruding portion protruding in a direction toward the first position, wherein the engagement release member first engaging portion include:

an engagement release member first vertically protruding portion protruding from the engagement release member main body toward an upper direction, and an engagement release member horizontally protruding portion protruding from the engagement release member first vertically protruding portion in a direction toward the second position, and wherein when the first sub-member is engaged with the main member, a tip end portion of the first sub-member first protruding portion is directed toward a lateral surface of the engagement release member first vertically protruding portion and an upper surface of the first sub-member first protruding portion is directed toward a bottom surface of the engagement release member horizontally protruding portion.

11. The medicine dispensing cassette as recited in claim 10, wherein the first sub-member first protruding portion has an inclined surface facing a direction between the direction toward the first position and a lower direction, and wherein the engagement release member horizontally protruding portion has an inclined surface facing a direction between the direction toward the second position and the upper direction.

12. The medicine dispensing cassette as recited in claim 9, wherein the first sub-member second engaging portion includes a first sub-member second protruding portion protruding toward the lower direction and the first sub-member second protruding portion has a lateral surface facing a direction toward the first position, wherein the engagement release member second engaging portion includes an engagement release member second vertically protruding portion protruding from the engagement release member main body toward the upper direction and the engagement release member second vertically protruding portion has a lateral surface facing a direction toward the second position, and wherein when the engagement release member is moved to the first position, the lateral surface of the first sub-member second protruding portion makes contact with the lateral surface of the engagement release member second vertically protruding portion.

13. The medicine dispensing cassette as recited in claim 12, wherein the first sub-member second protruding portion has an inclined surface facing a direction between the direction toward the second position and the lower direction, wherein the engagement release member second vertically protruding portion has an inclined surface facing a direction between the direction toward the first position and the upper direction, and wherein while the engagement release member is being moved to the first position, the inclined surface of the engagement release member second vertically protruding portion pushes up the inclined surface of the first sub-member second protruding portion, and thereby the first sub-member is moved toward the upper direction.

14. The medicine dispensing cassette as recited in claim 7, wherein the second sub-member includes a second sub-member first engaging portion and a second sub-member second engaging portion, wherein the engagement release member includes a lateral engaging portion provided so as to protrude from the engagement release member main body toward a lateral direction, wherein when the second sub-member is engaged with the main member, the second sub-member first engaging portion is engaged with the lateral engaging portion, and wherein when the engagement between the second sub-member and the main member is released, the second sub-member second engaging portion makes contact with the lateral engaging portion.

15. The medicine dispensing cassette claimed in claim 14, wherein the second sub-member first engaging portion includes:

a second sub-member first vertically protruding portion protruding from the second sub-member toward the lower direction, and a second sub-member horizontally protruding portion protruding from the second sub-member first vertically protruding portion in a direction toward the lower side of the lateral engaging portion, and wherein when the second sub-member is engaged with the main member, an upper surface of the second sub-member horizontally protruding portion faces a bottom surface of the lateral engaging portion.

16. The medicine dispensing cassette as recited in claim 15, wherein the second sub-member horizontally protruding portion has an inclined surface facing a direction between the direction toward the second position and the lower direction, and wherein the lateral engaging portion has an inclined surface facing a direction between the direction toward the first position and the upper direction.

17. The medicine dispensing cassette as recited in claim 14, wherein the second sub-member second engaging portion further includes a second sub-member second vertically protruding portion protruding toward the lower direction and the second sub-member second vertically protruding portion has an inclined surface facing a direction toward the second position, wherein the lateral engaging portion includes an opening portion opening toward the upper direction and the opening portion internally has an inner surface facing a direction toward the first position, and wherein when the engagement release member is moved to the second position, the lateral surface of the second sub-member second vertically protruding portion makes contact with the inner surface of the opening portion.

18. The medicine dispensing cassette as recited in claim 17, wherein the second sub-member second vertically protruding portion has an inclined surface facing a direction between the direction toward the first position and the lower direction, wherein the lateral engaging portion has an inclined surface facing a direction between the direction toward the second position and the upper direction, and wherein while the engagement release member is being moved to the second position, the inclined surface of the lateral engaging portion pushes up the inclined surface of the second sub-member second vertically protruding portion, and thereby the second sub-member is moved toward the upper direction.

19. The medicine dispensing cassette as recited in claim 14, wherein the engagement release member further includes an operating portion protruding toward a direction opposite to the lateral engaging portion, and wherein the operating portion is exposed on the outside of the main member.

20. The medicine dispensing cassette as recited in claim 19, wherein the engagement release member and each portion of the engagement release member are integrally formed from one material.

* * * * *